US005976775A

United States Patent [19]

Ishii

[11] Patent Number: 5,976,775

[45] Date of Patent: Nov. 2, 1999

[54] SILVER HALIDE COLOR PHOTOGRAPHIC LIGHT-SENSITIVE MATERIAL

[75] Inventor: Yoshio Ishii, Minami-Ashigara, Japan

[73] Assignee: Fuji Photo Film Co., Ltd., Kanagawa, Japan

[21] Appl. No.: 08/988,385

[22] Filed: Dec. 10, 1997

[30] Foreign Application Priority Data

Dec. 10, 1996 [JP] Japan ..... 8-344497

[51] Int. Cl.[6] ..... G03C 1/76; G03C 1/775; G03C 1/825

[52] U.S. Cl. ..... 430/505; 430/506; 430/507; 430/510; 430/512; 430/20

[58] Field of Search ..... 430/505, 507, 430/512, 510, 506, 20

[56] References Cited

U.S. PATENT DOCUMENTS 3,663,228 5/1972 Wyckoff ..... 430/507
3,849,138 11/1974 Wyckoff ..... 430/506

FOREIGN PATENT DOCUMENTS 1519993 8/1978 United Kingdom .

*Primary Examiner*—Richard L. Schilling
*Assistant Examiner*—Amanda C. Walke
*Attorney, Agent, or Firm*—Birch Stewart Kolasch & Birch, LLP

[57] ABSTRACT

In a silver halide color photographic light-sensitive material having each at least one red-sensitive silver halide emulsion layer (RL), green-sensitive silver halide emulsion layer (GL) and blue-sensitive silver halide emulsion layer (BL) on a support and further having a hydrophilic colloidal layer (AH-1) containing black colloidal silver between the support and the nearest light-sensitive silver halide emulsion layer, wherein the light-sensitive material further has a light-sensitive silver halide emulsion layer (DL) between the hydrophilic colloidal layer (AH-1) and the support, wherein the silver halide emulsion layer (DL) comprises at least one light-sensitive silver halide emulsion, and optical information is recorded by an exposure to light through the support, and the light-sensitive emulsion layer (DL) or its adjacent layer has a color-forming coupler.

8 Claims, No Drawings

SILVER HALIDE COLOR PHOTOGRAPHIC LIGHT-SENSITIVE MATERIAL

BACKGROUND OF THE INVENTION

The present invention relates to a silver halide color photographic light-sensitive material and, more particularly, to a silver halide color photographic light-sensitive material having a silver halide emulsion layer for recording optical information produced by exposure from a back side thereof, in which the recorded information has a sufficient density for reading the information after developing treatment.

In the present specification, a front side of a photographic material means the side on which a red-sensitive, green-sensitive and blue-sensitive silver halide emulsions are coated. On the other hand, a back side of a photographic material means the reverse side against the support to the front side mentioned above.

Silver halide color photographic light-sensitive materials, particularly color photographic light-sensitive materials for photographing are strongly required to give excellent images.

In addition, at photographing with cameras, a date and time of photographing are optically recorded by exposure from a back side of a photographic material for photographing. After developing process of the photographic material for photographing, this information is optically recorded on another light-sensitive material for printing, together with a subject which was exposed from the front side of the photographic material.

Although this optical record is recorded, in some cases, outside an image plane on which an image of a subject is recorded, i.e., unexposed part, the record, in many cases, is recorded inside the image plane on which a subject is recorded and at a part near the margin of the image plane (for example, right downer from the image plane).

For this reason, the record becomes very difficult to be read depending upon color, density and shape of the subject which has been exposed from the front side in some cases and, thus, there was a demand for improvement.

As an amount of a colorant to be coated, such as black colloidal silver in an antihalation layer and an amount of silver halide in an emulsion layer are reduced, an amount of light to be exposed from the back side is increased and it is possible to raise a density of the optical record to some extent.

According to this method, although the effect of raising a density of optical record from the back side is observed on a part having a lower image density of the subject which was obtained by exposure from the front side, the effect of raising a density of optical record is small on a part having a higher image density of the subject which was obtained from the front side.

In addition, it is well known that as black colloidal silver in an antihalation layer is coated at a lower amount, sharpness is reduced. Moreover, besides this reduction, an infrared absorbing density of a light-sensitive material is reduced and it becomes impossible to detect the light-sensitive material with infrared rays in a developing apparatus and, which leads to potential conveyance troubles and incorrect replenishment of a developer.

Conversely speaking, when an amount of black colloidal silver to be coated in an antihalation layer is increased in order to improve reduction in sharpness or enhance an infrared absorbing density, a density of optical record is further reduced and it becomes difficult to read it.

On the other hand, British Patent 1,519,993 has proposed an invention which improves the interlayer effect by inclusion of colloidal silver in water-impermeable layer adjacent both a green-sensitive layer and a red-sensitive layer. However, the inclusion of colloidal silver has no effect of raising a density of optical record by exposure from a back side.

BRIEF SUMMARY OF THE INVENTION

It is an object of the present invention to provide a silver halide color photographic light-sensitive material in which optical information exposed from the back side has a sufficient density for reading its information after the light-sensitive material is treated by developing processing.

As a result of extensive studies, the object of the present invention could be achieved by a silver halide color photographic light-sensitive material having the following features:

(1) A silver halide color photographic light-sensitive material having at least one red-sensitive silver halide emulsion layer (RL), at least one green-sensitive silver halide emulsion layer (GL) and at least one blue-sensitive silver halide emulsion layer (BL) on a support, and further having a hydrophilic colloidal layer (AH-1) containing black colloidal silver between the support and the nearest light-sensitive silver halide emulsion layer to the support among the red-sensitive silver halide emulsion layer (RL), the green-sensitive silver halide emulsion layer (GL) and the blue-sensitive silver halide emulsion layer (BL), wherein the light-sensitive material further has a light-sensitive silver halide emulsion layer (DL) between the hydrophilic colloidal layer (AH-1) and the support, wherein the silver halide emulsion layer (DL) comprises at least one light-sensitive silver halide emulsion, and optical information is recorded by an exposure to light through the support; and the light-sensitive emulsion layer (DL) or its adjacent layer has a color-forming coupler;

(2) The light-sensitive material according to the aforementioned (1), which further has a hydrophilic colloidal layer (AH-2) containing black colloidal silver, between the light-sensitive emulsion layer (DL) and the support;

(3) The light-sensitive material according to the aforementioned (1), wherein an amount of coated black colloidal silver contained in the hydrophilic colloidal layer (AH-1) ranges from 0.01 $g/m^2$ to 1.0 $g/m^2$ in terms of silver;

(4) The light-sensitive material according to the aforementioned (3), wherein the amount of coated black colloidal silver ranges from 0.25 to 1.0 $g/m^2$ in terms of silver;

(5) The light-sensitive material according to the aforementioned (2), wherein the total amount of coated black colloidal silver contained in the hydrophilic colloidal layers (AH-1) and (AH-2) ranges from 0.01 $g/m^2$ to 1.0 $g/m^2$ in terms of silver;

(6) The light-sensitive material according to the aforementioned (5), wherein the total amount of coated black colloidal silver ranges from 0.25 $g/m^2$ to 1.0 $g/m^2$ in terms of silver.

(7) The light-sensitive material according to any one of the aforementioned (1) to (6), wherein an infrared absorbing concentration of the light-sensitive material at 950 nm is not less than 1.7; and (8) The light-sensitive material according to any one of the aforementioned (1) to (7), wherein at least one of the light-sensitive emulsions contained in the silver halide emulsion layer (DL) for recording optical information by an exposure through the support, is a red-sensitive silver halide emulsion.

DETAILED DESCRIPTION OF THE INVENTION

The present invention will be described in detail below.

First, the hydrophilic colloidal layer containing black colloidal silver which is placed between the support and the nearest light sensitive silver halide emulsion layer among the red-sensitive, green-sensitive, and blue-sensitive layers (hereinafter this hydrophilic colloidal layer is referred to as AH-1), the light sensitive silver halide emulsion layer for recording optical information by exposure through the support which is placed between the support and AH-1 (hereinafter this light-sensitive silver halide emulsion layer is referred to as DL), and the hydrophilic colloidal layer containing black colloidal silver which is placed between the support and DL (hereinafter this hydrophilic colloidal layer is referred to as AH-2) will be described.

In the light-sensitive material of present invention, AH-1 is essential whereas the advantages of the present invention can be exerted even without AH-2. However, it is more preferably that AH-2 is coated.

AH-1 is a hydrophilic colloidal layer containing black colloidal silver, which is placed adjacent to DL and is disposed at remoter position from the support than DL.

AH-1 may be coated directly on DL, or may be coated on DL via one hydrophilic colloidal layer. The hydrophilic colloidal layer interposed between AH-1 and DL may be light-sensitive or non light-sensitive.

DL is a light-sensitive emulsion layer, which is placed adjacent to the support.

DL may be coated directly on the support, or may be coated on the support via at least one hydrophilic colloidal layer. In case there is no AH-2, which will be mentioned below, the hydrophilic colloidal layer interposed between DL and the support may be light-sensitive or non light-sensitive.

AH-2 is a hydrophilic colloidal layer containing silver colloidal silver, which is placed adjacent to DL and is disposed at nearer position from the support than DL.

AH-2 may be formed directly on the support, or may be coated on the support via one hydrophilic colloidal layer. The hydrophilic colloidal layer interposed between the support and AH-2 may be liqht-sensitive or non light-sensitive.

AH-2 may be coated directly under DL, or may be coated below DL via one hydrophilic colloidal layer. The hydrophilic colloidal layer interposed between AH-2 and DL may be light-sensitive or non light-sensitive.

An amount of black colloidal silver in AH-1 to be coated, in case AH-2 is absent, and an amount of black colloidal silver to be coated in AH-1 and AH-2, in case both AH-1 and AH-2 are coated, are not limited to specified ones, but the amount can be determined depending on the amount of silver contained in the silver halide layers of the light-sensitive material excluding the amount of silver coated in AH-1 and AH-2, if there is AH-2. The total coated amount of AH-1 and AH-2, if there is AH-2, is preferably set so that an infrared absorbing concentration of a light-sensitive material at 950 nm is not less than 1.7. More preferably, it is not less than 1.8, further preferably not less than 2.0. The infrared absorbing concentration of 1.7 or more are selected because detection with an infrared detector requires a minimum concentration of not less than 1.7 and higher concentration gives rise to no problem with regard to the detection with the infrared detector. At higher infrared absorbing concentration, a reading possibility with an infrared detector is increased.

That is, when an amount of a silver halide emulsion to be coated is small, since infrared absorption by the silver halide emulsion is small, it is preferable that an amount of black colloidal silver to be coated is set at larger.

Although the preferable total amount of black colloidal silver in AH-1 and AH-2, if there is AH-2, to be coated varies depending upon the amount of the silver coated in layers of the light-sensitive material excluding the amount of the silver coated both in AH-1 and AH-2, an approximate amount per $m^2$ of the light-sensitive material preferably ranges from 0.01 $g/m^2$ to 1.0 $g/m^2$ in terms of silver. More preferably, it ranges from 0.25 $g/m^2$ to 1.0 $g/m^2$.

When both AH-1 and AH-2 are coated, a ratio of black colloidal silver to be coated in AH-1 to that in AH-2 may be any one and suitably determined depending upon the sensitivity of the silver halide emulsion to be coated in DL. Preferably, an amount of black colloidal silver in AH-1 is not less than 10% of the total amount of black colloidal silver coated both in AH-1 and AH-2.

AH-1 and AH-2 may contain a conventional ingredient for photography such as a silver halide emulsion and a coupler (including a functional coupler such as a colored coupler, DIR coupler, etc.), in addition to black colloidal silver. Preferably, AH-1 contains a magenta coupler and/or a dye. Further, a colored coupler, or a coupler and a previously fogged emulsion may be added to AH-1, in order to maintain a minimal density. On the other hand, AH-2 preferably contains a cyan coupler. Further, a colored coupler, or a coupler and a previously fogged emulsion may be added to AH-2, in order to maintain a minimal density. Specific couplers and other ingredients to be contained in AH-1 or AH-2 will be described below. One of ordinary shill in the art can prepare each coating solution of AH-1 and AH-2, in accordance with the known methods for preparing the coating solution of an antihalation layer.

AH-1 and AH-2 may be constituted by two or more sub-layers, respectively, and these sub-layers may contact to each other or be apart from each other. In case the sub-layers are apart from each other, one hydrophilic colloidal layer can be interposed between the sub-layers. The interposed layer may be light-sensitive or non light-sensitive.

When AH-1 or AH-2 is constituted by two or more sub-layers, the aforementioned preferable amounts of black colloidal silver to be coated in the layer is the total amount coated in all the sub-layers of AH-1 or AH-2, respectively.

The silver halide emulsion contained in DL may be any one of red-sensitive, green-sensitive and blue-sensitive ones and two or more ones may be used in admixture thereof. The silver halide emulsions to be used in admixture thereof may have the same or different color sensitivities. Preferably, the silver halide emulsion is red-sensitive silver halide emulsion. The composition of the silver halide is silver iodobromide, silver iodochloride or silver iodochlorobromide containing about 30 mol % or less of silver iodide. A preferable silver halide is silver iodobromide or silver iodochlorobromide each containing about 2 mol % to about 10 mol % of silver iodide.

The amount of silver halide emulsion to be coated in DL is preferably 0.01 $g/m^2$ to 0.5 $g/m^2$, more preferably 0.03 $g/m^2$ to 0.15 $g/m^2$, in terms of silver.

The coupler contained in DL may be a coupler which forms any color of cyan, magenta or yellow. However, a cyan coupler is preferable, since information recorded by the exposure of the light through the support is usually, i.e., in case where no DL exists, recorded in a red-sensitive layer. In addition, a functional coupler such as DIR coupler and the like, a compound which reacts with a developing agent in an oxidized form, such as hydroquinones, and a conventional material or agent for photography may be contained therein. Specific couplers to be contained in DL will be described below.

In addition, in a case where a color-forming coupler is not contained in DL, the advantages of the present invention can be attained if a color-forming coupler is contained in the layers next to DL. That is, the color-forming coupler may be contained in at least one of the hydrophilic colloidal layer between AH-1 and DL; in the hydrophilic colloidal layer between DL and AH-2, in case AH-2 is present; in AH-2, again, in case AH-2 is present; and in the hydrophilic colloidal layer between DL and the support, in case AH-2 is not present. The color-forming coupler may be contained both in DL and at least one of the layers next to DL mentioned above.

DL may be constituted by two or more sub-layers. These sub-layers may be adjacent to or apart from each other. In case the sub-layers are apart from each other, one hydrophilic colloidal layer can be interposed between the sub-layers. The interposed layer may be light-sensitive or non light-sensitive.

One of ordinary shill in the art can prepare the coating solution of DL, in accordance with the known methods to prepare a coating solution of ordinary light-sensitive layer, such as BL, GL and RL.

In addition, DL may produce a color image by exposure from the front side of the light-sensitive material, in addition to exposure from the back side thereof.

Black colloidal silver used in the present invention will be described.

Although, in the field of silver halide color photographic light-sensitive materials, colloidal silver such as yellow colloidal silver for filtering yellow light and black colloidal silver that is effective for preventing or reducing halation are generally known. The advantages of the present invention are attained by using the black colloidal silver normally used for preventing or reducing halation.

In addition, as used herein, black colloidal silver includes not only ones whose absorption characteristics does not depend on wave length but also, for example, brownish gray colloidal silver and others. That is, any ones that are effective for preventing or reducing halation are all included.

These colloidal silver can be prepared by the previously known methods, for example, a method by reducing a soluble silver salt in a gelatin solution as found in U.S. Pat. No. 2,688,601, a method by reducing a sparingly-soluble silver salt with hydrazine as described in West German Patent 1,096,193, a method by reducing with tannic acid to silver as described in U.S. Pat. No. 2,921,914, a method by forming silver particles by electroless plating as described in Jpn. Pat. Appln. KOKAI Publication No. (hereinafter referred to as JP-A-)5-134358.

The light-sensitive material of the present invention needs to have at least one red-sensitive emulsion layer, at least one green-sensitive emulsion layer and at least one blue-sensitive emulsion layer on a support. A typical example of the light-sensitive materials of the present invention is a silver halide photographic light-sensitive material having, on the support, at least three light-sensitive layer, each constituted by a plurality of silver halide emulsion layers which are sensitive to the same color but which have different sensitivities or speeds. The light-sensitive layer is a unit light-sensitive layer which is sensitive to any one of blue light, green light and red light and, in a multi-layered silver halide color photographic light-sensitive material, a generally adopted order of the unit light-sensitive layers from the support is red-sensitive layer, a green-sensitive layer and a blue-sensitive layer. However, according to the intended use, this order of layers may be reversed, or a layer having a different color sensitivity may be sandwiched between layers having the same color sensitivity in accordance with the application. Non-light-sensitive layers can be formed between the silver halide light-sensitive layers and as the uppermost layer and the lowermost layer. These non-light-sensitive layers can contain couplers, DIR compounds, color mixture preventives and the like to be described later. As a plurality of silver halide emulsion layers constituting a unit light-sensitive layer, a two-layered structure of high-speed and low-speed emulsion layers can be preferably arranged such that the sensitivity or speed is sequentially decreased toward a support as described in West German Patent 1,121,470 or British Patent 923,045. Alternatively, as described in JP-A-57-112751, JP-A-62-200350, JP-A-62-206541 and JP-A-62-206543, layers may me arranged such that a low-speed emulsion layer is formed remotely from a support and a high-speed layer is formed close to the support.

Specifically, layers may be arranged in an order from the remotest side from a support of low-speed blue-sensitive layer (BL)/high-speed blue-sensitive layer (BH)/high-speed green-sensitive layer (GH)/low-speed green-sensitive layer (GL)/high-sensitive red-sensitive layer (RH)/low-speed red-sensitive layer (RL), or BH/BL/GL/GH/RH/RL, or BH/BL/GH/GL/RL/RH or the like.

Further, layers may be arranged in an order from the remotest side from a support of blue-sensitive layer/GH/RH/GL/RL as described in Jpn. Pat. Appln. KOKOKU Publication No. (hereinafter referred to as JP-B-)55-34932. Alternatively, layers may be arranged in an order of from the remotest side from a support of blue-sensitive layer/GL/RL/GH/RH as described in JP-A-56-25738 and JP-A-62-63936.

Further, as described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer, i.e., the three layers having different sensitivities may be arranged such that the sensitivity is sequentially decreased toward the support. Also, when the light-sensitive material comprises the three layers having different sensitivities or speed, these layers may be arranged from far to near the support in the order of medium-speed emulsion layer/high-speed emulsion layer/low-speed emulsion layer within a layer sensitive to one and the same color sensitivity as described in JP-A-59-202464.

In addition, an order of high-speed emulsion layer/low-speed emulsion layer/medium-speed emulsion layer, or an order of low-speed emulsion layer/medium-speed emulsion layer/high-speed emulsion layer may be adopted.

Furthermore, the arrangement can be changed as described above, even when four or more layers are formed.

In order to improve color reproductivity, a donor layer (CL) for providing an interlayer effect having different spectral sensitivity distribution from that of a main light-sensitive layer such as BL, GL and RL, described in the specification of U.S. Pat. No. 4,663,271, U.S. Pat. No. 4,705,744, U.S. Pat. No. 4,707,436, JP-A-62-160448 and JP-A-63-89850, is preferably arranged next to or in the vicinity of the main light-sensitive layer.

A preferable silver halide to be used in photographic emulsion layers of the photographic light-sensitive material of the present invention is silver iodobromide, silver iodochloride or silver iodochlorobromide containing about 30 mol % or less of silver iodide. A particularly preferable silver halide is silver iodobromide or silver iodochlorobromide each containing about 2 mol % to about 10 mol % of silver iodide.

The silver halide grains contained in the photographic emulsion may be in the form of regular crystals, such as cubes, octahedrons and decatetrahedrons, irregular crystals, such as spheres and tabulars, crystals having defects such as twin planes, or composite shapes thereof.

The grain sizes (diameter) of the silver halide may range from fine grains having a grain diameter of about 0.2 μm or less or to large grains having a diameter of the projected area of a grain of up to about 10 μm. Further, the silver halide emulsion may be a polydisperse emulsion or a monodisperse emulsion.

The silver halide photographic emulsion usable both in the light-sensitive layers placed farther from the support than AH-1, i.e., RL, GL and BL, and in the light-sensitive layers placed nearer to the support than AH-1, i.e., DL, in the present invention can be prepared by the methods described, for example, in Research Disclosure (hereinafter abbreviated as RD) No. 17643 (December 1978), pages 22-23, "I. Emulsion Preparation and Types"; RD No. 18716 (November 1979), page 648, and RD No. 307105 (November 1989), pages 863–865; P. Glafkides, "Chimie et Physique Photographiques", Paul Montel, 1967; G. F. Duffin, "Photographic Emulsion Chemistry", Focal Press 1966; and V. L. Zelikman et al., "Making and Coating Photographic Emulsion", Focal Press, 1964.

Also preferable is the monodisperse emulsion described in U.S. Pat. No. 3,574,628, U.S. Pat. No. 3,655,394 and British Patent 1,413,748.

Further, tabular grains having an aspect ratio of about 3 or more can also be used in the present invention. The tabular grains can be easily prepared by the methods described in Gutoff, "Photographic Science and Engineering", Vol. 14, pp. 248–257 (1970); U.S. Pat. Nos. 4,434,226; 4,414,310; 4,433,048 and 4,439,520, and British Patent 2,112,157.

The crystal structure may be uniform, may have different halogen compositions in its inner portion and its outer portion, or may be layered structure. Alternatively, silver halide having different compositions may be joined by an epitaxial junction, or a compound other than a silver halide such as silver rhodanide or lead oxide may be joined. A mixture of grains having various crystal forms may also be used.

The above-mentioned emulsion needs to be a negative-type emulsion, although it may be of a surface latent image type which forms a latent image mainly on the surface of the grains, an internal latent image type which forms a latent image inside the grains, or other type which forms a latent image both at a surface and internal portion of the grain. The emulsion belonging to the internal latent image type may be of the internal latent image type having a core/shell structure described in JP-A-63-264740, the method for making which emulsion is described in JP-A-59-133542. The thickness of the shell for this emulsion is preferably 3 to 40 nm and most preferably 5 to 20 nm, although the thickness varies depending on processing conditions for development and the like.

Prior to the use of the emulsion used in the light-sensitive material of present invention, the silver halide usually undergoes a chemical ripening, a physical ripening, and a spectral sensitization steps. The additives which are used at such steps are described in RD No. 17643, RD No. 18716 and RD No. 307105 and are summarized later in a table with the indications of the relevant places of description.

In the light-sensitive material of the present invention, a mixture of two or more emulsions, which differ from one another is at least one of the characteristics selected from the group consisting of grain size, grain size distribution, halogen composition, shape of grain and sensitivity, can be used in the same layer.

It is preferable to use silver halide grains surface-fogged grain described in U.S. Pat. No. 4,082,553, silver halide grains having internally fogged grain described in U.S. Pat. No. 4,626,498 and JP-A-59-214852, or colloidal silver in a light-sensitive silver halide emulsion layer and/or in a substantially non-light-sensitive hydrophilic colloidal layer. The silver halide grains having internally fogged grain or surface-fogged silver halide grain is the one capable of being developed uniformly (non-imagewise) irrespective of the unexpected and exposed portions of the light-sensitive material. The method for making the internally fogged or surface-fogged silver halide grains is described in U.S. Pat. No. 4,626,498 and JP-A-59-214852. The silver halide, which constitutes the inner core of core/shell-type silver halide grains having the internally fogged grain, may have a different halogen composition. The silver halide grains having internally fogged grain or surface-fogged grain may be any silver halide selected from the group consisting of silver chloride, silver chlorobromide, silver iodobromide and silver chloroiodobromide. The average grain sizes (diameter) of these fogged silver halide grains are in the range of 0.01 to 0.75 μm, and more preferably in the range of 0.05 to 0.6 μm. Although the emulsion may be made up of grains having regular shapes or may be a polydisperse emulsion, it is preferably a monodisperse emulsion (in which at least 95% in weight or in number of silver halide grains have grain diameters falling within the range of ±40% or less of the average diameter).

It is preferable to use non-light-sensitive silver halide fine grains in the present invention. The non-light-sensitive silver halide fine grains mean the silver halide fine grains which are not sensitized in the imagewise exposure for forming a dye image and are substantially undeveloped when processed for development. Preferably, the non-light-sensitive silver halide fine grains are not fogged in advance. The fine-grain silver halide has a silver bromide content of 0 to 100 mol %. If necessary, the fine-grain silver halide may further contain silver chloride and/or silver iodide, preferably contain silver iodide in an amount of 0.5 to 10 mol %. The average grain diameter (average value of the equivalent-circular diameter of the projected area of the grain) of the fine-grain silver halide is preferably 0.01 to 0.5 μm, and more preferably 0.02 to 0.2 μm.

The fine silver halide grain can be prepared by the same method as that for a conventional light-sensitive silver halide. No optical sensitization or spectral sensitization is necessary for the surface of the grains of the silver halide. However, it is preferable to add to the silver halide grains a known stabilizer such as triazole compounds, azaindene compounds, benzothiazole compounds, mercapto compounds or zinc compounds, before the silver halide grains are added to a coating solution. A layer, which contains the fine silver halide grain, may further contain colloidal silver.

The total coating amount of silver of the light-sensitive material of the present invention is preferably 6.0 g/m$^2$ or less, and most preferably 4.5 g/m$^2$ or less.

The photographic additives usable in the present invention are also described in RD and the following table shows the additives together with the relevant places of description.

| Additives | RD17643 | RD18716 | RD307105 |
|---|---|---|---|
| 1. Chemical sensitizer | p 23 | p 648, r.c. | p 866 |
| 2. Sensitivity enhancing agent | | p 648, r.c. | |
| 3. Spectral sensitizer Super sensitizer | p 23–24 | p 648, r.c. – p 649, r.c. | p 866–868 |
| 4. Brightener | p 24 | p 647, r.c. | p 868 |
| 5. Light absorber, Filter dye, Ultraviolet absorbent | p 25–26 | p 649, r.c. – p 650, l.c. | p 873 |
| 6. Binder | p 26 | p 651, l.c. | p 873–874 |
| 7. Plasticizer, Lubricant | p 27 | p 650, r.c. | p 876 |
| 8. Coating aid, Surfactant | p 26–27 | p 650, r.c. | p 875–876 |
| 9. Antistatic agent | p 27 | p 650, r.c. | p 876–877 |
| 10. Matting agent | | | p 878–879 |

(Note) p: page
r.c.: right column
l.c.: left column

Various dye forming couplers can be used in the light-sensitive material of the present invention, and the following couplers are particularly preferable.

Yellow couplers: couplers represented by formulas (I) and (II) in European Patent (hereinafter referred to as EP) 502,424A; couplers (particularly Y-28 on page 18) represented by Formulas (1) or (2) in EP 513,496A; couplers represented by Formula (I) in claim 1 of EP 568,037A; couplers represented by Formula (I) in column 1, lines 45 to 55, in U.S. Pat. No. 5,066,576; couplers represented by Formula (I) in paragraph 0008 of JP-A 4-274425 whose corresponding U.S. application is U.S. Pat. No 5,296,339; couplers (particularly D-35 on page 18) described in claim 1 on page 40 of EP 498,381 A1; couplers (particularly) Y-1 (page 17) and Y-54 (page 41)) represented by Formula (Y) on page 4 in EP 447,969A1; and couplers (particularly II-17 and II-19 (column 17) and II-24 (column 19)) represented by Formulas (II) to (IV) in column 7, lines 36–58, in U.S. Pat. No. 4,476,219. The disclosures of all the above mentioned references that disclose the yellow couplers are herein incorporated by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP 456,257; M-4 and M-6 (page 26), and M-7 (page 27) in EP 486,965; M-45 (page 19) in EP 571,959A; (M-1) (page 6) in JP-A 5-204106; and M-22 in paragraph 0237 of JP-A-4-362631. The disclosures of all the above mentioned references that disclose the magenta couplers are herein incorporated by reference.

Cyan couplers: CX-1, CX-3, CX-4, CX-5, CX-11, CX-12, CX-14, and CX-15 (pages 14 to 16) in JP-A 4-204843; C-7 and C-10 (page 35), C-34 and C-35 (page 37), and (I-1) and (I-17) (pages 42 and 43) in JP-A-4-43345; and couplers represented by Formula (Ia) or (Ib) described in claim 1 of JP-A-6-67385. The disclosures of both of the above mentioned references that disclose the cyan couplers are herein incorporated by reference.

Polymer couplers: P-1 and P-5 (page 11) in JP-A-2-44345, the disclosure of which is herein incorporated by reference.

Couplers for forming a colored dye having a proper diffusibility are preferably those described in U.S. Pat. No. 4,366,237, British Patent 2,125,570, EP 96,873B and D.E 3,234,533, the disclosures of which are herein incorporated by reference.

Preferable couplers for correcting unnecessary absorption of a colored dye are yellow colored cyan couplers (particularly YC-86 on page 84) represented by Formulas (CI), (CII), (CIII) and (CIV) described on page 5 in EP 456,257A1; yellow colored magenta couplers ExM-7 (page 202), Ex-1 (page 249) and Ex-7 (page 251) in EP 456, 257A1; magenta colored cyan couplers CC-9 (column 8) and CC-13 (column 10) described in U.S. Pat. No. 4,833, 069; coupler (2) (column 8) in U.S. Pat. No. 4,837,136; the disclosure of which are herein incorporated by reference and colorless masking couplers (particularly compound examples on pages 36 to 45) represented by Formula (A) described in claim 1 of WO/11,575.

Example of a compound (including a coupler) which reacts with a developing agent in an oxidized form and releases a photographically useful compound residue are as follows. Development inhibitor releasing compounds: compounds (particularly T-101 (page 30), T-104 (page 31), T-113 (page 36), T-131 (page 45), T-144 (page 51) and T-158 (page 58)) represented by Formula (I), (II), (III) or (IV) described on page 11 in EP 378,236A1; compounds (particularly D-49 (page 51)) represented by Formula (I) described on page 7 in EP 436,938A2; compounds (particularly (23) (page 11)) represented by Formula (I) in EP 568,037A; compound (particularly I-(1) on page 29) represented by Formula (I), (II) or (III) described on pages 5 and 6 in EP 440,195A2; bleaching accelerator-releasing compounds: compounds (particularly (60) and (61) on page 61) represented by Formulas (I) or (I') described on page 5 in EP 310,125A2; and compounds (particularly (7) (page 7)) represented by Formula (I) described in claim 1 of JP-A-6-59411; ligand-releasing compounds: compounds (particularly compounds in column 12, lines 21 to 41) represented by LIG-X described in claim 1 of U.S. Pat. No. 4,555,478; leuco dye-releasing compounds; compounds 1 to 6 in columns 3 to 8 of U.S. Pat. No. 4,749,641; fluorescent dye-releasing compounds; compounds (particularly compounds 1 to 11 in columns 7 to 10) represented by COUP-DYE described in claim 1 of U.S. Pat. No. 4,774,181; development accelerators or fogging agent-releasing compounds; compounds (particularly compounds (I-22) in column 25) represented by Formulas (1), (2) and (3) described in column 3 of U.S. Pat. No. 4,656,123, and compounds represented by ExZK-2 described on page 75, lines 36 to 38, in EP 450,637A2; and compounds which release a group which dose not function as a dye unless it splits off; compounds (particularly Y-1 to Y-19 in columns 25 to 36) represented by Formula (I) in claim 1 of U.S. Pat. No. 4,857,447. The disclosures of all the above mentioned references that disclose the compounds that react with the developing agent in an oxidized form and release a photographically useful compound, are herein incorporated by reference.

Preferable examples of additive other than couplers are as follows:

Dispersants of an oil-soluble organic compound: P-3, P-5, P-16, P-19, P-25, P-30, P-42, P-49, P-54, P-55, P-66, P-81, P-85 p-86 and P-93 (pages 140 to 144) in JP-A-62-215272; impregnating latexes of an oil-soluble organic compound: latexes described in U.S. Pat. No. 4,199,363; developing agent in an oxidized form scavengers: compounds (particularly I-(1), I-(2), I-(6) and I-(12) (columns 4 and 5)) represented by Formula (I) in column 2, lines 54 to 62, in U.S. Pat. No. 4,978,606, and formulas (particularly compound 1 (column 3)) in column 2, lines 5 to 10, in U.S. Pat. No. 4,923,787; stain inhibitors; Formulas (I) to (III) on page 4, lines 30 to 33, particularly I-47, I-72, III-1 and III-27 (pages 24 to 48) in EP 298,321A; discoloration inhibitors: A-6, A-7, A-20, A-21, A-23, A-24, A-25, A-26, A-30, A-37, A-40, A-42, A-48, A-63, A-90, A-92, A-94 and A-164 (pages 69 to 118) in EP 298,321A, II-1 to III-23, particularly III-10, in columns 25 to 38 of U.S. Pat. No. 5,122,444, I-1 to III-4, particularly II-2, on pages 8 to 12 in EP 471,347A, and A-1 to A-48, particularly A-39 and A-42, in columns 32 to 40 of U.S. Pat. No. 5,139,931; materials which reduce the use amount of a color enhancer or a color amalgamation inhibitor: I-1 to II-15, particularly I-46, on pages 5 to 24 in EP 411,324A; formalin scavengers: SCV-1 to SCV-28, particularly SCV-8, on pages 24 to 29 in EP 477,932A; film hardeners: H-1, H-4, H-6, H-8 and H-14 on page 17 in JP-A-1-214845, compounds (H-1 to H-54) represented by Formulas (VII) to (XII) in columns 13 to 23 of U.S. Pat. No. 4,618,573, compounds (H-1 to H-76), particularly H-14, represented by Formula (6) on page 8, lower right column, in JP-A-2-214852, and compounds described in claim 1 of U.S. Pat. No. 3,325,287; development inhibitor precursors: P-24, P-37 and P-39 (pages 6 and 7) in JP-A-62-168139 and compounds described in claim 1, particularly 28 and 29, in column 7, of U.S. Pat. No. 5,019,492; antiseptic agents and mildewproofing agents: I-1 to III-43, particularly II-1, II-9, II-10, II-18 and III-25, in columns 3 to 15 of U.S. Pat. No. 4,923,790; stabilizers and aitifoggants: I-1 to (14), particularly I-1, I-60, (2) and (13), in columns 6 to 16 of U.S. Pat. No. 4,923,793, and compounds 1 to 65, particularly compound 36, in columns 25 to 32 of U.S. Pat. No. 4,952,483; chemical sensitizes: triphenylphosphine selenide, compound 50 described in JP-A-5-40324; dyes: a-1 to b-20, particularly a-1, a-12, a-18, a-27, a-35 and a-36 and b-5 on pages 15 to 18, and V-1 to V-23, particularly V-1, on pages 27 to 29 in JP-A-3-156450, F-I-1 to F-II-43, particularly F-I-11 and F-II-8, on pages 33 to 55 in EP 445,627A, III-1 to III-36, particularly III-1 and III-3, on pages 17 to 28 in EP 457,153A, fine crystal dispersions of Dye-1 to Dye-124 on pages 8 to 26 in WO 88/04,794, compounds 1 to 22, particularly compound 1, on pages 6 to 11 in EP 319,999A, compounds D-1 to D-87 (pages 3 to 8) represented by Formulas (1) to (3) in EP 519,306A, compounds 1 to 22 (columns 3 to 10) represented by Formulas (I) in U.S. Pat. No. 4,268,622, and compounds (1) to (31) (columns 2 to 9) represented by Formulas (I) in U.S. Pat. No. 4,923,788; and UV absorbents: compounds (18b) to (18r) and 101 to 427 (pages 6 to 9) represented by Formulas (1) in JP-A-46-3335, compounds (3) to (66) (pages 10 to 44) represented by Formula (I) and compounds HBT-1 to HBT-10 (page 14) represented by Formula (III) in EP 520,938A, and compounds (1) to (31) (columns 2 to 9) represented by Formula (1) in EP 521,823A. The disclosures of all the above mentioned references that disclose the additives other than couplers, are herein incorporated by reference.

The light-sensitive material of the present invention can be applied to various color light-sensitive materials such as a color negative film for a general purpose or a movie and a color reversal film for a slide or a television, a color paper, a color positive film and a color reversal paper. The light-sensitive material of the present invention is also suited to film units with lens described in JP-B-2-32615 and Jpn. Utility Model Appln. KOKOKU Publication No. (hereinafter referred to as JU-B-) 3-39784.

A support which can be suitably used in the present invention is described in, e.g., RD No. 17,643, page 28, RD No. 18,716, from right column, page 647, to left column, page 648, and RD No. 307,105, page 879.

In the light-sensitive material of the present invention, the sum total of film thickness of all hydrophilic colloid layers on the side having the emulsion layers (the front side) is preferably 28 $\mu$m or less, more preferably 23 $\mu$m or less, particularly preferably 18 $\mu$m or less, and most preferably 16 $\mu$m or less. A film-swelling speed $T_{1/2}$ is preferably 30 seconds or less, and more preferably 20 seconds or less. $T_{1/2}$ is defined as a time which the film thickness requires to reach ½ of a saturation film thickness which is 90% of a maximum swell film thickness reached when processing is performed by using a color developer at 30° C. for 3 min. and 15 seconds. The film thickness means the thickness of a film measured under moisture conditioning at a temperature of 25° C. and a 55% relative humidity (two days). $T_{1/2}$ can be measured by using a swell meter described in Photographic Science Engineering, A. Green et al., Col. 19, No. 2, pp. 124–129. $T_{1/2}$ can be adjusted by adding film hardening agent to gelatin as a binder or changing aging conditions after coating. The swelling ratio is preferably 150 to 400%. The swelling ratio can be calculated from the maximum swell film thickness under the conditionings mentioned above by using the formula: (maximum swell film thickness - film thickness)/film thickness.

In the light-sensitive material of the present invention, hydrophilic colloid layers (called back layers) having a total dried film thickness of 2 to 20 $\mu$m are preferably formed on the side opposite to the side having emulsion layers, i.e. the back side. The back layers preferably contain, e.g., the light absorbent, the filter dye, the ultraviolet absorbent, the antistatic agent, the film hardener, the binder, the plasticizer, the lubricant, the coating aid, and the surfactant, described above. The swelling ratio of the back layer is preferably 150 to 500%.

The light-sensitive material of the present invention can be processed for development by a conventional method described in aforesaid RD No. 17,643, pages 28 and 29, RD No. 18,716, page 651, from left column to right column, and RD No. 307,105, pages 880 and 881.

The processing solution for a color negative film of the present invention is described below.

The color developing solution used in the present invention may contain the compounds described in JP-A-4-121739, page 9, upper right column, line 1 to page 11, lower left column, line 4. Preferred developing agents for the rapid processing are 2-methyl-4-[N-ethyl-N-(2-hydroxyethyl) amino]aniline, 2-methyl-4-[N-ethyl-N-(3-hydroxypropyl) amino]aniline and 2-methyl-4-[N-ethyl-N-(4-hydroxybutyl) amino]aniline.

The concentration of these color developing agents is preferably 0.01 to 0.08 mol, more preferably 0.015 to 0.06 mol, and most preferably 0.02 to 0.05 mol per liter of the color developing solution. The concentration of these color developing agents in a replenisher solution of the color developing solution is preferably 1.1 to 3 times, more preferably 1.3 to 2.5 times, the concentration in the color developing solution.

As a preservative for the color developing solution used in the present invention, a hydroxylamine can widely be used. If a higher-level preservation is required, preferable preservatives are hydroxylamine derivatives having substituents such as alkyl, hydroxyalkyl, sufoalkyl and carboxyl alkyl groups, practical examples of which are N,N-di (sulfoethyl)hydroxylamine, monomethylhydroxylamine, dimethylhydroxylamine, monoethylhyroxylamine, diethylhydroxylamine and N,N-di(carboxylethyl)hydroxylamine. Among the above-mentioned derivatives, N,N-di (sulfoethyl)hydroxylamine is particularly preferable. Although any of these derivatives may be used in combination with hydroxylamine, preferably one, or two or more of these derivatives are used instead of hydroxylamine.

The concentration of the preservative is preferably 0.02 to 0.2 mol, more preferably 0.03 to 0.15 mol, and most preferably 0.04 to 0.1 mol per liter of the color developing solution. The concentration of the preservative in a replenisher solution of the color developing solution is 1.1 to 3 times the concentration in the mother solution (i.e., the solution in the processing tank).

In order to prevent the tarring of the developing agent in an oxidized form, the color developing solution may contain a sulfite. The concentration of the sulfite is preferably 0.01 to 0.05 mol and particularly preferably 0.02 to 0.04 mol per liter of the color developing solution. The concentration of the sulfite in a replenisher solution of the color developing solution is 1.1 to 3 times the concentration mentioned above.

The pH value of the color developing solution is preferably 9.8 to 11.0 and particularly preferably 10.0 to 10.5. The pH value of a replenisher solution of the color developing solution is set to a value preferably 0.1 to 1.0 above the above-mentioned values. In order to maintain pH at the above-mentioned values in a stable manner, a known buffer solution such as a carbonate, a phosphate, a sulfosalicylate or a borate is used.

The quantity of replenisher of the color developing solution is preferably 80 to 1,300mL (milliliter) per $m^2$ of the light-sensitive material. From the viewpoint of reducing the polluting load to environment, the quantity should be reduced and is preferably 80 to 600 mL, more preferably 80 to 400 mL.

The bromide ion concentration in the color developing solution is usually 0.01 to 0.06 mol per liter of the color developing solution. Preferably, the bromide ion concentration is set to 0.015 to 0.03 mol per liter of the color developing solution for the purpose of fog inhibition and enhancement of discrimination while maintaining the sensitivity and for improving graininess. If the bromide ion concentration is set to the above-mentioned range, the replenisher solution needs to contain the bromide ions at the concentration given by the following equation; provided that the replenisher solution preferably contains no bromide ion if the calculated value C is negative.

$$C=A-W/V$$

where

C: Bromide ion concentration (mol/L) of the replenisher solution of the color developing solution;

A: target bromide ion concentration (mol/L) in the color developing solution;

W: Amount (mol) of the bromide ions which dissolve into the color developing solution from the light-sensitive material when 1 $m^2$ of the light-sensitive material was processed for development; and V: Quantity of replenisher of the color developing solution per $m^2$ of the light-sensitive material If the quantity of replenisher is reduced or the bromide ion concentration is set to a large value, it is preferable to use development accelerators, such as pyrazolidones represented by 1-phenyl-3-pyrazolidone or 1-phenyl-2-methyl-2-hydroxymethyl-3-pyrazolidone, and thioether compounds represented by 3,6-dithia-1,8-octanediol, as a means for increasing the sensitivity.

The compounds or processing conditions, which are described in JP-A-4-125558, page 4, lower left column, line 16 to page 7, lower left column, line 6, can be applied to the processing solution having a bleaching power for use in the present invention.

A preferable bleaching agent has a redox potential of 150 mV or more. Practical examples of the bleaching agents are those described in JP-A-5-72694 and JP-A-5-173312. Particularly preferred examples are 1,3-diaminopropanetetraacetic acid and ferric complex salts of the compounds shown as practical example 1 on page 7 in JP-A-5-173312.

It is preferable to use the ferric complex salts of the compounds described in JP-A-4-251845, JP-A-4-268552, EP 588,289, EP 591,934 and JP-A-6-208213 as a bleaching agent to increase the biodegradability of the bleaching agent. The concentration of the bleaching agent is preferably 0.05 to 0.3 mol per liter of the solution having a bleaching power. Preferably, the concentration is set to 0.1 to 0.15 mol in order to reduce the discharge amount to environments. If the solution having a bleaching power is a bleaching solution, it is desirable that the solution contain the bromide ions at a concentration of 0.2 to 1 mol, preferably 0.3 to 0.8 mol, per liter of the solution.

The replenisher solution of the solution having a bleaching power needs to have concentration of the components shown below which are basically calculated by the following equation. As a result, the concentration in the mother solution can be maintained at a constant value.

$$C_R=C_T\times(V_1+V_2)/V_1+C_p$$

where $C_R$: Concentration of the component in the replenisher solution;

$C_T$: Concentration of the component in the mother solution (tank solution);

$C_p$: Concentration of the component consumed during the processing;

$V_1$: Quantity (mL) of replenisher solution having a bleaching power per $m^2$ of the light-sensitive material; and $V_2$: Quantity (mL) carried over from the preceding bath per $m^2$ of the light-sensitive material.

Further, it is preferable that the bleaching solution contain a pH buffering agent, preferred examples of which are low-odor dicarboxylic acids such as succinic acid, maleic acid, malonic acid, glutaric acid and adipic acid. It is also preferable to use known bleaching accelerators described in JP-A-53-95630, RD No. 17,129 and U.S. Pat. No. 3,893,858.

It is desirable that the bleaching solution be supplied with 50 to 1,000 mL, preferably 80 to 500 mL, and most preferably 100 to 300 mL of a replenisher solution of the bleaching solution per $m^2$ of the light-sensitive material. Further, it is preferable that the bleaching solution be aerated.

The compounds or processing conditions, which are described in JP-A-4-125558, page 7, lower left column, line 10 to page 8, lower right column, line 19, can be applied to the processing solution having a fixing power used in the present invention.

In particular, in order to increase the fixing speed and the preservability of the solution, the solution having a fixing power preferably contains the compounds represented by the Formulas (I) and (II) in JP-A-6-301169 singly or as a combination. In addition, from the viewpoint of the enhancement of the preservability, it is preferable to use a sulfinic acid, such as p-toluenefulfinic acid salt, described in JP-A-1-224762.

When viewed from the enhancement of the desilvering capability, it is desirable that the solution having a bleaching power or a fixing power contain ammonium as a cation. However, it is preferable to decrease the ammonium content of the solution or to make the solution ammonium-free from the viewpoint of the reduction of the environmental pollution.

It is particularly preferable to carry out the jet-agitation of the solution described in JP-A-1-309059 at the steps of bleaching, bleach-fixing and fixing.

The quantity of replenisher at a bleach-fixing step or fixing step is 100 to 1,000 mL, preferably 150 to 700 mL, and most preferably 200 to 600 mL per $m^2$ of the light-sensitive material.

Preferably, the bleach-fixing step or fixing step is provided with an in-line or off-line silver recovery unit so that the silver is recovered. If an in-line unit is used, the quantity of replenisher can be reduced, because the silver concentration in the solution in the bath becomes smaller owing to the treatment. Meanwhile, it is also desirable to remove the silver by means of an off-line unit so that the residual solution is re-used as a replenisher solution.

The bleach-fixing step or fixing step may comprises a plurality of processing tanks, which are preferably arranged by a multistage counter-current method employing cascade piping. Because of the balance with the size of the processor, in general a two-tank cascade structure is efficient wherein the ratio of the processing time between the fore tank and the rear tank is preferably in the range of 0.5:1 to 1:0.5 and particularly preferably in the range of 0.8:1 to 1:0.8

From the viewpoint of increasing the preservability, the bleach-fixing solution or fixing solution preferably contains a free chelating agent which is not in the form of a complex with a metal. These chelating agents are preferably biodegradable chelating agents previously described in connection with the bleaching solution.

The techniques described in JP-A-4-125558, page 12, lower right column, line 6 to page 13, lower right column, line 16 can be preferably applied to the water-washing and stabilizing step. Particularly, in order to preserve the acceptable working environments, it is preferable to incorporate the stabilizing solution with azolylmethylamines described in EP 504,609 and EP 519,190 or an N-methylolazoles described in JP-A-4-362943 as formaldehyde substitute compounds and to make the magenta coupler two-equivalent for the purpose of utilizing a solution of a surface active agent free of a formaldehyde-based image stabilizer.

Meanwhile, in order to reduce the amount of dusts adhering to the magnetic recording layer coated on the light-sensitive material, the stabilizing solution described in JP-A-6-289559 may be preferably used.

The quantity if replenisher of washing water or of the stabilizing solution is 80 to 1,000 mL, preferably 100 to 500 mL, and most preferably 150 to 300 mL per $m^2$ of the light-sensitive material both from securing the water-washing or stabilizing function and from the reduction of waste solution in view of the environmental preservation. In the processing which is performed with the above-mentioned quantity of replenisher, it is preferable to use a known mildewproofing agent, such as thiabendazole, 1,2-benzoisothiazoline-3-one or 5-chloro-2methylisothiazoline-3-one, an antibiotic, such as gentamycin, and deionized water which has been deionization-treated with an ion-exchange resin in order to prevent the growth of bacteria or mildew. The use of a combination of deionized water with an anti-bacteria agent or an antibiotic is more effective.

Furthermore, it is desirable to reduce the amount of replenisher by the implementation of the reverse osmosis of the liquid inside the water-washing or stabilizing solution tank as described in JP-A-3-46652, JP-A-3-53246, JP-A-3-55542, JP-A-3-121448 and JP-A-3-126030. In this case, the reverse osmosis membrane is preferably a low-pressure reverse osmosis membrane.

In the processing for the light-sensitive material of the present invention, it is particularly preferable to compensate for the evaporation of the processing solutions in accordance with the method described in Journal of Technical Disclosure No. 94-4992 of The Japan Institution of Innovation and Invention (hereinafter abbreviated as JIII). In particular, it is desirable to compensate for the evaporation based on the Equation (1) on page 2 by used of the temperature and humidity information in the environment where the processor is placed. The water to be used to compensate for evaporation is preferably taken from a replenishment tank of the water-washing bath, and the replenishing water is preferably deionized water.

The processing agents described in the above-mentioned Journal of Technical Disclosure, page 3, right column, line 15 to page 4, left column line 32 are desirable for use in the present invention. A desirable processor using these processing agents is the film processor described in the above-mentioned Journal of Technical Disclosure, page 3, right column, lines 22 to 28.

Practical examples of the desirable processing agents, automatic processors and methods for compensating for evaporation are described in the above-mentioned Journal of Technical Disclosure, page 5, right column, line 11 to page 7, right column, final line.

The supply form of a processing agent to be used in the present invention can be any of a liquid having the concentration of a solution in use, a concentrated liquid, a granule, a powder, a pellet, a paste and an emulsion. Examples of these processing agents are a liquid contained in a low-oxygen-permeability vessel disclosed in JP-A-63-17453, vacuum-packaged powders or granules disclosed in JP-A-4-19655 and JP-A-4-230748, granules containing a water-soluble polymer disclosed in JP-A-4-221951, pellets disclosed in JP-A-51-61837 and JP-A-6-102628, and a processing agent in the form of a paste disclosed in PCT National Publication No. 57-500485. Any of these forms can be preferably used. However, in respect of simplicity in use, the use of a liquid already prepared to have a concentration in use is preferable.

The material of vessels containing these processing agents can be any of polyethylene, polypropylene, polyvinylchloride, polyethylene terephthalate and nylon. These materials can be used singly or in the form of a composite material. These materials are so selected as to meet the level of a necessary oxygen permeability. Low-oxygen-permeability materials are suited to a solution such as a color developing solution that is readily oxidized. Practical examples are polyethylene terephthalate and a composite material of polyethylene and nylon. The thickness of a vessel made from any of these materials is 500 to 1,500 μm. The oxygen permeability is preferably 20 $mL/m^2 \cdot 24$ hrs·atm or less.

The processing solution for the color reversal film to be used in the present invention is described below. The detail of the processing technique for a color reversal film is described in Journal of Known Technologies No. 6 Apr. 1, 1991, issued from ASTECH Co., Ltd.), page 1, line 5 to page 10, line 5 and page 15, line 8 to page 24, line 2. Any of these techniques can be preferably used in the present invention.

In the processing of the color reversal film, the control bath or the final bath contains the image stabilizing agent. Among examples of these image stabilizing agents which are formalin, sodium formaldehydebisulfite and N-methylolazole, preferable is sodium formaldehydebisulfite or N-Methylolazoles, N-methyloltriazole in particular, from the viewpoint of working environments. Further, the techniques, which were stated previously concerning the color developing solution, bleaching, fixing solution and washing water for the processing of color negative film, can also be preferably used for the processing of the color reversal film.

On the basis of the above description, preferred processing agents for color reversal films include E-6 Processing Agent manufactured by Eastman Kodak Co., Ltd. and CR-56 Processing Agent manufactured by Fuji Film Co., Ltd.

Then, a magnetic recording layer used in the present invention is described.

The magnetic recording layer used in the present invention is formed by coating the surface of a support with an aqueous or organic solvent-based coating solution which is prepared by dispersing magnetic grains in a binder.

The magnetic grains used in the present invention can be ferromagnetic iron oxide such as γ $Fe_2O_3$, Co-deposited γ $Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite and Ca ferrite. Co-deposited ferromagnetic iron oxide such as Co-deposited γ $Fe_2O_3$ is preferable. The grain can take the shape of any of, e.g., a needle, a rice grain, a sphere, a cube and plate. A specific surface area is preferably 20 $m^2/g$ or more, and more preferably 30 $m^2/g$ or more as $S_{BET}$.

The saturation magnetization (σ s) of the ferromagnetic substance is preferably $3.0\times10^4$ to $3.0\times10^5$ A/m, and most preferably $4.0\times10^4$ to $2.5\times10^5$ A/m. A surface treatment can be performed for the ferromagnetic grains by use of silica and/or alumina or an organic material. Also, the surface of the ferromagnetic grains can be treated with a silane coupling agent or a titanium coupling agent as described in JP-A-6-161032. Ferromagnetic grains, whose surface is coated with an inorganic or organic substance, described in JP-A-4-259911 and JP-A-5-81652 can also be used.

As the binder used together with the magnetic grains, it is possible to use a thermoplastic resin, a thermosetting resin, a radiation-curable resin, a reactive resin, an acid-, alkali- or bio-degradable polymer, a natural polymer (e.g., a cellulose derivative and a saccharide derivative) and their mixtures described in JP-A-4-219569. Tg of the resin is −40° C. to 300° C., and its weight average molecular weight is 2,000 to 1,000,000. Examples of the resin are vinyl copolymer, cellulose derivatives, such as cellulose diacetate, cellulose triacetate, cellulose acetatepropionate, cellulose acetatebutylate and cellulose tripropionate, an acrylic resin, and a polyvinylacetal resin. Gelatin is also preferable. Cellulose di(tri)acetate is particularly preferable. The binder can be hardened by the addition of an epoxy, aziridine, or isocyanate crosslinking agent. Examples of the isocyanate crosslinking agent include isocyanates, such as tolylenediisocyanate, 4,4'-diphenylmethanediisocyanate, hexamethylenediisocyanate and xylylenediisocyanate, reaction products of these isocyanates and polyalcohols (e.g., a reaction product of 3 mols of tolylenediisocyanate and 1 mol of trimethylolpropane), and a polyisocyanate produced by condensation of any of these isocyanates. These examples are described in, e.g., JP-A-6-59367.

As a method for dispersing the magnetic substance in the binder, as described in JP-A-6-35092, the use of a kneader, a pin-type mill or an annular mill is preferable, and a combination of them is also preferable. Dispersants described in JP-A-5-088283 and other known dispersants can be used. The thickness of the magnetic recording layer is 0.1 to 10 μm, preferably 0.2 to 5 μm, and more preferably 0.3 to 3 μm. The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, most preferably 0.02 to 0.5 $g/m^2$. The transmission yellow density of the magnetic recording layer is preferably 0.01 to 0.50, more preferably 0.03 to 0.20, and most preferably 0.04 to 0.15. The magnetic recording layer can be formed in the whole area of, or in the shape of stripes on, the back surface of a photographic support by coating or printing. The magnetic recording layer can be formed by any coating method using, e.g., an air doctor, a blade, an air knife, squeezing, impregnation, a reverse roll, a transfer roll, gravure, kissing, casting, spray, dipping, a bar or extrusion. A coating solution described in JP-A-5-341436 is preferable.

The magnetic recording layer may have additional functions such as improvement of lubricating property, adjustment of curing, electrostatic charge prevention, adhesion prevention and polish of head. Alternatively, an additional functional layer may be formed which performs these functions. A preferable polishing agent contains at least one type of aspherical inorganic grains which have a Mohs hardness of 5 or more. The composition of the aspherical inorganic grain is preferably an oxide, such as aluminum oxide, chromium oxide, silicon dioxide and titanium carbide, or a fine powder of diamond. The surfaces of the grains constituting these polishing agents can be treated with a silane coupling agent or a titanium coupling agent. These grains can be added to the magnetic recording layer, or the magnetic recording can be overcoated with a layer containing these grains (e.g., as a protective layer or a lubricating layer). The binder to be used together with the grains can be of any of those described above and is preferably the same binder as in the magnetic recording layer. Light-sensitive materials having the magnetic recording layer are described in U.S. Pat. Nos. 5,336,589; 5,250,404; 5,229,259 and 5,215,874, and EP 466,130.

A polyester support to be used for the light-sensitive material of the present invention having a magnetic recording layer is described below. Details of the polyester support, light-sensitive materials, treatment, cartridges and examples are described in Journal of Technical Disclosure No. 94-6, 023 (JIII; Mar. 15, 1994). The polyester used in the present invention is made up of a diol and an aromatic dicarboxylic acid as essential components. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethyleneglycol, triethyleneglycol, cyclohexanedimethanol, bisphenol A and bisphenol.

Examples of the polymer are homopolymers such as polyethylene terephthalate, polyethylene naphthalate and polycyclohexanedimethanol terephthalate. The polyester containing 50 to 100 mol % of 2,6-naphthalenedicarboxylic acid is particularly preferable. Polyethylene 2,6-naphthalate is most preferable among these polymers. The average molecular weight ranges between 5,000 and 200,000. Tg of the polyesters for use in the present invention is 50° C. or higher, preferably 90° C. or higher.

In order to make the polyester support more resistant to curling, the polyester support is heat-treated at a temperature within the range of from 40° C. to less than Tg, more preferably at a temperature within the range of from Tg−20° C. to less than Tg. The heat treatment can be performed at a fixed temperature within this range or can be performed together with cooling. The heat-treatment time is 0.1 to 1,500 hours, more preferably 0.5 to 200 hours. The heat treatment can be performed for a roll-like support or while the support is conveyed in the form of a web. Fine undulations (e.g., coating the surface with electroconductive inorganic fine grains such as $SnO_2$ or $Sb_2O_5$) may be given to the surface to improve the surface condition. It is also desirable to knurl and slightly raise the end portion, thereby preventing the shape of cut portion of the core from being transmitted. These heat treatment can be performed at any stage, for example, after support film formation, after surface treatment, after back layer coating (e.g., an antistatic agent or lubrication agent) and after the application of an undercoat. A preferable timing for the heat treatment is after the application of the antistatic agent.

An ultraviolet absorbent may be incorporated into this polyester. Also, the prevention of light piping can be achieved by incorporating the polyester with a dye or pigment, such as Diaresin manufactured by Mitsubishi Chemical Industries, Ltd. or Kayaset manufactured by Nippon Kayaku Co., Ltd., which is commercially available as an additive to polyester.

In the present invention, it is preferable to perform a surface treatment of the support in order to increase the bonding strength between the support and the light-sensitive material constituting layers. Examples of the surface treatment are surface activating treatments which include a chemical treatment, a mechanical treatment, a corona discharge treatment, a flame treatment, an ultraviolet treatment, a high-frequency treatment, a glow discharge treatment, an active plasma-treatment, a laser treatment, a mixed acid treatment and an ozone oxidation treatment. Preferred surface treatments are the ultraviolet irradiation treatment, the flame treatment, the corona treatment and the glow treatment.

The undercoat may contain of a single layer of two or more layers. Examples of the binder for the undercoat layer include a copolymer produced by using, as a starting material, a monomer selected from the group consisting of vinyl chloride, vinylidene chloride, butadiene, methacrylic acid, acrylic acid, itaconic acid, maleic anhydride and the like. Other examples include polyethyleneimine, an epoxy resin, grafted gelatin, nitrocellulose and gelatin. Resorcin and p-chlorophenyl are examples of a compound which swells the support. Examples of a gelatin hardener to be added to the undercoat layer include chromium salts (e.g., chromium alum), aldehydes (e.g., formaldehyde and glutaraldehyde), isocyanates, active halogenated compounds (e.g., 2,4-dichloro-6-hydroxy-s-triazine), epichlorohydrin resins and active vinylsulfones. The undercoat layer may contain $SiO_2$, $TiO_2$, inorganic fine grains or fine grains of a polymethyl methacrylate copolymer (0.01 to 10 μm) as a matting agent.

For the light-sensitive material of the present invention having a magnetic recording layer, an antistatic agent is preferably used. Examples of the antistatic agent include polymers containing carboxylic acid group, carboxylate group or a sulfonate group, cationic polymers and ionic surfactant compounds.

It is most preferable to use as the antistatic agent at least one finely-divided crystalline metal oxide which is selected from the group consisting of ZnO, $TiO_2$, $SnO_2$, $Al_2O_3$, $In_2O_3$, $SiO_2$, MgO, BaO, $MoO_3$ and $V_2O_5$ and which has a volume resistivity of $10^7$ Ω·cm or less, more preferably $10^5$ Ω·cm or less, and a grain size of 0.001 to 1.0 μm, fine grains of composite oxides (e.g., Sb, P, B, In, S, Si and C) of these metal oxides, fine grains of sol metal oxides, or fine grains of composite oxides of these sol metal oxides.

The content of the antistatic agent in the light-sensitive material is preferably 5 to 500 mg/m$^2$, and most preferably 10 to 350 mg/m$^2$. The weight ratio of an electroconductive crystalline oxide or its composite oxide to the binder is preferably 1/300 to 100/1 and more preferably 1/100 to 100/5.

The light-sensitive material of the present invention preferably has a slip property. Slip agent-containing layers are preferably formed on the surfaces of both a light-sensitive layer and a back layer. A preferable slip property is indicated by a coefficient of kinetic friction of 0.01 to 0.25. This value represents the value that is obtained when a sample is conveyed at a speed of 60 cm/min while keeping contact with a stainless steel ball having a diameter of 5 mm (25° C., 60% RH). In this evaluation, a value of nearly the same level is obtained even when the stainless steel ball is replaced with the surface of a light-sensitive layer.

Examples of the slip agent usable in the present invention are polyorganosiloxanes, higher fatty acid amides, metals salts of higher fatty acids, and esters of higher fatty acids and higher alcohols. Examples of the polyorganosiloxanes include polydimethylsiloxane, polydiethylsiloxane, polystyrylmethylsiloxane and polymethylphenylsiloxane. A layer to which the slip agent is added is preferably the outermost emulsion layer or the back layer. Polydimethylsiloxanes or esters having a long-chain alkyl group are particularly preferable.

The light-sensitive material of the present invention preferably contains a matting agent. Although the matting agent can be added to either the emulsion surface or the back surface, it is most preferably added to the outermost layer on the side having the emulsion layer. The matting agent can be either soluble or insoluble in the processing solutions, and the use of a combination of both types of the matting agents is preferable. Preferable examples are polymethylmethacrylate grains, poly(methylmethacrylate/methacrylic acid=9/1 or 5/5 (molar ratio)) grains and polystyrene grains. The grain size is preferably 0.8 to 10 μm, and a narrow grain size distribution is preferable. It is preferable that 90% or more by number of all or the grains have grain sizes of 0.9 to 1.1 times the average grain size. To increase the matting effect, it is preferable to simultaneously add fine grains having a grain size of 0.8 μm or less, examples of which include polymethylmethacrylate grains (0.2 μm), poly (methylmethacrylate/methacrylic acid=9/1 (molar ratio) grains (0.3 μm), polystyrene grains (0.25 μm) and colloidal silica (0.03 μm).

A film patrone to be used for the light-sensitive material of the present invention is described below. The principal material of the cartridge to be used in the present invention can be a metal or synthetic plastic.

Examples of preferable plastic materials include polystyrene, polyethylene, polypropylene and polyphenylene ether. The cartridge used for the present invention can also contain various antistatic agents. For this purpose, carbon black, metal oxide grains, nonionic, anionic or betaine surfactants, or polymers can be preferably used. These cartridge subjected to the antistatic treatment are described in JP-A-1-312537 and JP-A-1-312538. It is particularly preferable that the resistance be $10^{12}$ Ω or less at 25° C. and 25% RH. Commonly, plastic patrone are manufactured by using plastics into which carbon black or pigments are incorporated to give a light-shielding property. The patrone size can be a presently available 135 size. For the purpose of down-sizing the cameras, it is effective to decrease the diameter of 25-mm cartridge of 135 size to 22 mm or less. The volume of a cartridge case is 30 $cm^3$ or less, preferably 25 $cm^3$ or less. The weight of the plastic used in the patrone and the patrone case is preferably 5 to 15 g.

Furthermore, a patrone which feeds a film by rotating a spool can be used in the present invention. It is also possible to use a structure in which a film leader is housed in a patrone main body and fed through a port of the cartridge to the outside by rotating a spool shaft in the film feed direction. These structures are disclosed in U.S. Pat. Nos. 4,834,306 and 5,226,613. Photographic films to be used in the present invention can be so-called raw films before being developed or developed photographic films. Also, raw and developed photographic films can be accommodated in the same new patrone or in different patrone.

The color photographic light-sensitive material of the present invention is also suitable as a negative film for use in Advanced Photo System (hereinafter referred to AP system) and examples of which are formed by processing films in AP system format like NEXIA A, NEXIA F and NEXIA H (in this order; ISO 200/100/400) manufactured by Fuji Photographic Film, Ltd. (hereinafter referred to Fuji Film) and accommodating them in an exclusive cartridge. These cartridge films for use in AP system are used by charging into cameras for AP system such as Epion Series (such as Epion 300Z) manufactured by Fuji Film. In addition, the color photographic light-sensitive material of the present invention is also suitable for films with a lens such as "Fuji Color Utsurundesu, Super Slim" manufactured by Fuji Film.

The films photographed by them are printed in Mini Lab System through the following steps.

(1) Receiving (Receiving of the exposed cartridge film from a customer)

(2) Detachment step (The film is transferred from the cartridge to an intermediate cartridge for developing step)

(3) Film development (4) Reattachment step (The developed negative film is returned to the original cartridge)

(5) Print (C/H/P of three types of prints and an index print are printed successively and automatically printed on color print papers (preferably SUPER FA8 manufactured by Fuji Film)

(6) Collation and shipment (The cartridge and the index print are collated using ID number and shipped together with the print)

The preferable system for this is Fuji Film Mini Lab Champion Super FA-298/FA-278/FA-258/FA-238 and Fuji Film Digital Lab System Frontier. An example of a film processor for Mini Lab Champion includes FP922AL/FP562B/FP562B, AL/FP362B/FP362B, AL and the recommended treating agent is Fuji Color Just It CN-16L and CN-16Q. An example of a printer processor includes PP3008AR/PP3008A/PP1828AR/PP1828A/PP1258AR/PP1258A/PP728AR/PP728 A and the recommended treating agent is Fiji Color Just It CP-47L and CP-40FAII. In Frontier System, Scanner & Image Processor SP-1000 and Laser Printer & Paper Processor LP-1000P or Laser Printer LP-1000W are used. The preferable detacher used in detachment step and the preferable retacher used in reattachment step are DT200/DT100 and AT200/AT100 manufactured by Fuji Film, respectively.

AP system can be also enjoyed by Photo Joint System, a principle of which is Fuji Film, Digital Image Work Station, Aladdin 1000. The resultant digital image can be easily processed and compiled by directly charging the developed AP system cartridge film into Aladdin 1000 or inputting image information of a negative film, a positive film and a print using a 35 mm film scanner, FE-550 or a flight head scanner, PE-550. The data can be outputted as a print by a digital color printer, NC-550AL in a manner of a light fixing type heat-sensitive color print or pictrography 3000 in a manner of laser exposure heat development transfer, or by the known lab machine through a film recorder. Alternatively, in Aladdin 1000, digital information can be inputted directly into a floppy disk and Zip disk or into CD-R through CD writer.

On the other hand, at homes, photographs can be enjoyed through TV simply by charging the developed AP system cartridge film into a photo-player AP-1 manufactured by Fuji Film, or alternatively, image information can be incorporated into a personal computer at a high speed by charging the above cartridge film into a photo scanner AS-1 manufactured by Fiji Film. In addition, in order to input a film, a print or a solid into a personal computer, a photo-vision FV-10/FV-5 manufactured by Fiji Film can be utilized. Further, image information recorded on a floppy disk, Zip disk, CD-R or a hard disk can be enjoyed by processing in a variety ways on a personal computer using Fuji, Application Software Photo-Factory. In order to output a high quality print from a personal computer, a digital color printer NC-2/NC-2D in a manner of light fixing type heat-sensitive color print. manufactured by Fuji Film is suitable.

In order to accommodate the developed AP system cartridge film, Fuji Color, a pocket albums, AP-5 Pop L, AP-1 Pop L and AP-1 Pop KG or a cartridge file 16 are preferable.

EXAMPLES

The present invention will be described in more detail below by way of its examples. However, the present invention is not limited to these examples as long as the invention dose not depart from the gist of the invention.

Example 1

The following components were coated on cellulose triacetate film having a thickness of 127 μm, to prepare Sample 101.

(Compositions of light-sensitive layers)

The main materials used in the individual layers were classified as follows but the use thereof are not limited to those indicated herein.

ExC: Cyan coupler, UV: Ultraviolet absorbent

ExM: Magenta coupler, HBS: High-boiling organic solvent

ExY: Yellow coupler, H: Gelatin hardner

ExS: Sensitizing dye

The number corresponding to each component indicates the coating amount in units of g/m$^2$. The coating amount of a silver halide is represented by the amount of silver. The coating amount of each sensitizing dye is represented in units of mol per mol of a silver halide in the same layer.

(Sample 101)

| | | |
|---|---|---|
| 1st layer (1st antihalation layer) (corresponding to AH-2) | | |
| Black colloidal silver | silver | 0.075 |
| Gelatin | | 0.70 |
| ExC-2 | | 0.05 |
| 2nd layer | | |
| Gelatin | | 0.50 |
| 3rd layer (2nd antihalation layer) (corresponding to AH-1) | | |
| Black colloidal silver | silver | 0.28 |
| Gelatin | | 1.00 |
| ExM-1 | | 0.10 |
| ExF-1 | | $2.0 \times 10^{-3}$ |
| Solid disperse dye | ExF-2 | 0.030 |
| Solid disperse dye | ExF-3 | 0.040 |
| HBS-1 | | 0.15 |
| HBS-2 | | 0.02 |
| 4th layer (Low-speed red-sensitive emulsion layer) | | |
| Silver iodobromide emulsion A | silver | 0.02 |
| Silver iodobromide emulsion B | silver | 0.05 |
| ExS-1 | | $3.3 \times 10^{-4}$ |
| ExS-2 | | $1.4 \times 10^{-5}$ |
| ExS-3 | | $4.6 \times 10^{-4}$ |
| ExC-1 | | 0.11 |
| ExC-2 | | 0.02 |
| ExC-3 | | 0.04 |
| ExC-4 | | 0.07 |
| ExC-5 | | 0.020 |
| ExC-6 | | 0.010 |
| ExM-4 | | 0.005 |
| ExY-1 | | 0.01 |
| Cpd-2 | | 0.025 |
| HBS-1 | | 0.10 |
| Gelatin | | 1.10 |
| 5th layer (Medium-speed red-sensitive emulsion layer) | | |
| Silver iodobromide emulsion B | silver | 0.32 |
| Silver iodobromide emulsion C | silver | 0.32 |
| ExS-1 | | $4.2 \times 10^{-4}$ |
| ExS-2 | | $1.8 \times 10^{-5}$ |
| ExS-3 | | $5.9 \times 10^{-4}$ |
| ExC-1 | | 0.18 |
| ExC-2 | | 0.05 |
| ExC-3 | | 0.06 |
| ExC-4 | | 0.07 |
| ExC-5 | | 0.02 |
| ExC-6 | | 0.02 |
| ExM-4 | | 0.02 |
| ExY-1 | | 0.005 |
| Cpd-4 | | 0.02 |
| Cpd-2 | | 0.02 |
| HBS-1 | | 0.10 |
| Gelatin | | 0.80 |
| 6th layer (High-speed red-sensitive emulsion layer) | | |
| Silver iodobromide emulsion D | silver | 0.27 |
| ExS-1 | | $3.5 \times 10^{-4}$ |
| ExS-2 | | $1.5 \times 10^{-5}$ |

-continued (Sample 101)

| | | |
|---|---|---|
| ExS-3 | | $4.9 \times 10^{-4}$ |
| ExC-1 | | 0.02 |
| ExC-2 | | 0.018 |
| ExC-3 | | 0.015 |
| ExC-6 | | 0.001 |
| ExC-7 | | 0.010 |
| ExM-4 | | 0.003 |
| Cpd-2 | | 0.040 |
| Cpd-4 | | 0.040 |
| HBS-1 | | 0.22 |
| HBS-2 | | 0.050 |
| Gelatin | | 1.10 |
| 7th layer (Interlayer) | | |
| Cpd-1 | | 0.060 |
| Solid disperse dye ExF-4 | | 0.030 |
| HBS-1 | | 0.040 |
| Polyethyl acrylate latex | | 0.15 |
| Gelatin | | 1.10 |
| 8th layer (low-speed green-sensitive emulsion layer) | | |
| Silver iodobromide emulsion E | silver | 0.15 |
| Silver iodobromide emulsion F | silver | 0.102 |
| Silver iodobromide emulsion G | silver | 0.15 |
| ExS-7 | | $7.5 \times 10^{-4}$ |
| ExS-8 | | $3.4 \times 10^{-4}$ |
| ExS-4 | | $2.5 \times 10^{-5}$ |
| ExS-5 | | $9.0 \times 10^{-5}$ |
| ExS-6 | | $4.3 \times 10^{-4}$ |
| ExM-3 | | 0.30 |
| ExM-4 | | 0.09 |
| ExY-1 | | 0.01 |
| ExY-5 | | 0.0020 |
| HBS-1 | | 0.30 |
| HBS-3 | | 0.015 |
| Cpd-4 | | 0.010 |
| Gelatin | | 0.95 |
| 9th layer (medium-speed green-sensitive emulsion layer) | | |
| Silver iodobromide emulsion G | silver | 0.2 |
| Silver iodobromide emulsion H | silver | 0.2 |
| ExS-4 | | $3.6 \times 10^{-5}$ |
| ExS-7 | | $1.7 \times 10^{-4}$ |
| ExS-8 | | $8.0 \times 10^{-4}$ |
| ExC-8 | | 0.0020 |
| ExM-3 | | 0.12 |
| ExM-4 | | 0.02 |
| ExY-1 | | 0.02 |
| ExY-4 | | 0.005 |
| ExY-5 | | 0.002 |
| Cpd-4 | | 0.015 |
| HBS-1 | | 0.13 |
| HBS-3 | | $4.4 \times 10^{-3}$ |
| Gelatin | | 0.80 |
| 10th layer (high-speed green-sensitive emulsion layer) | | |
| Silver iodobromide emulsion I | silver | 0.28 |
| ExS-4 | | $6.3 \times 10^{-5}$ |
| ExS-7 | | $1.7 \times 10^{-4}$ |
| ExS-8 | | $7.8 \times 10^{-4}$ |
| ExC-6 | | 0.01 |
| ExM-4 | | 0.02 |
| ExM-2 | | 0.005 |
| ExM-5 | | 0.001 |
| ExM-6 | | 0.001 |
| ExM-3 | | 0.04 |
| Cpd-3 | | 0.001 |
| Cpd-4 | | 0.040 |
| HBS-1 | | 0.25 |
| Polyethylacrylate latex | | 0.15 |
| Gelatin | | 1.33 |
| 11th layer (Yellow filter layer) | | |
| Yellow colloidal silver | silver | 0.015 |

-continued (Sample 101)

| | | |
|---|---|---|
| Cpd-1 | | 0.16 |
| Solid disperse dye ExF-5 | | 0.060 |
| Solid disperse dye ExF-6 | | 0.060 |
| Oil-soluble dye ExF-7 | | 0.010 |
| HBS-1 | | 0.60 |
| Gelatin | | 0.60 |
| 12th layer (low-speed blue-sensitive emulsion layer) | | |
| Silver iodobromide emulsion J | silver | 0.06 |
| Silver iodobromide emulsion K | silver | 0.06 |
| Silver iodobromide emulsion L | silver | 0.15 |
| ExS-9 | | $8.4 \times 10^{-4}$ |
| ExC-1 | | 0.03 |
| ExC-8 | | $7.0 \times 10^{-3}$ |
| ExY-1 | | 0.07 |
| ExY-2 | | 0.72 |
| ExY-3 | | 0.02 |
| ExY-4 | | 0.01 |
| Cpd-2 | | 0.005 |
| Cpd-4 | | 0.005 |
| Cpd-3 | | 0.004 |
| UV-2 | | 0.054 |
| UV-3 | | 0.054 |
| HBS-1 | | 0.28 |
| Gelatin | | 2.60 |
| 13th layer (high-speed blue-sensitive emulsion layer) | | |
| Silver iodobromide emulsion M | silver | 0.24 |
| ExS-9 | | $6.0 \times 10^{-4}$ |
| ExY-2 | | 0.005 |
| ExY-3 | | 0.24 |
| ExY-4 | | 0.0050 |
| Cpd-2 | | 0.10 |
| Cpd-3 | | $1.0 \times 10^{-3}$ |
| Cpd-4 | | $5.0 \times 10^{-3}$ |
| UV-2 | | 0.012 |
| UV-3 | | 0.012 |
| HBS-1 | | 0.075 |
| Gelatin | | 0.55 |
| 14th layer (1st protective layer) | | |
| Silver iodobromide emulsion N | silver | 0.10 |
| UV-1 | | 0.13 |
| UV-2 | | 0.10 |

-continued (Sample 101)

| | |
|---|---|
| UV-3 | 0.16 |
| UV-4 | 0.025 |
| ExF-8 | 0.03 |
| ExF-9 | 0.005 |
| ExF-10 | 0.005 |
| ExF-11 | 0.02 |
| HBS-1 | $5.0 \times 10^{-2}$ |
| HBS-4 | $5.0 \times 10^{-2}$ |
| Gelatin | 1.8 |
| 15th layer (2nd protective layer) | |
| H-1 | 0.40 |
| B-1 (diameter 1.7 μm) | 0.04 |
| B-2 (diameter 1.7 μm) | 0.09 |
| B-3 | 0.13 |
| ES-1 | 0.20 |
| Gelatin | 0.70 |

In addition to the above components, to improve storage stability, processability, a resistance to pressure, antiseptic and mildewproofing properties, antistatic properties and coating properties, the individual layers contained W-1 to W-3, B-4 to B-6, F-1 to F-18, iron salt, lead salt, gold salt, platinum salt, palladium salt, iridium salt and rhodium salt.

The average AgI contents and grain sizes of the emulsions A to L and X used in the above-mentioned Sample 101 and Samples 102 to 109 that are set forth below are shown in the following Table 1.

TABLE 1

| Emulsion | Average AgI Content (%) | Average Equivalent Spherical Diameter of the Grain (μm) | Deviation Coefficient of the Diameter (%) | Equivalent Circular Diameter of Projected Area of the Grain (μm) | Ratio of Diameter/Thickness | Tabularity |
|---|---|---|---|---|---|---|
| A | 2.8 | 0.28 | 13 | 0.28 | 1.5 | 8 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 2.8 | 0.28 | 13 | 0.28 | 1.5 | 8 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 5.4 | 0.72 | 23 | 1.10 | 6.3 | 36 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.8 | 0.88 | 30 | 1.12 | 4.7 | 20 |
| N | 1.0 | 0.07 | — | — | 1.0 | — |
| X | 3.7 | 0.37 | 13 | 0.43 | 2.3 | 12 |

In Table 1, (1) The emulsions J to M were reduction sensitized by use of thiourea dioxide and thiosulfonic acid at the time of grain preparation according to the examples described in JP-A-2-191938.

(2) The emulsions C to E, emulsion G to I and emulsion M were gold-sensitized, sulfur-sensitized and selenium-sensitized in the presence of a spectral sensitizing dye and sodium thiocyanate shown in the components of the individual light-sensitive layers according to the examples described in JP-A-3-237450.

(3) Low-molecular-weight gelatin was used for the preparation of tabular grains according to the examples described in JP-A-1-158426.

(4) Under a high-voltage electronic microscope, dislocation lines similar to those described in JP-A-3-237450 were observed on the tabular grains.

(5) The emulsions A to E, emulsions G and H, and emulsions J to M contain an optimal amounts of Rh, Ir and Fe. The tabularity is defined by $Dc/t^2$, where Dc represents an equivalent-circular average diameter of the projected area of a grain, and t represents the average thickness of tabular grains.

Preparation of dispersions of organic solid disperse dyes

ExF-2 was dispersed by the following method. 21.7 mL of water, 3 mL of 5% aqueous solution of p-octylphenoxyethoxyethoxyethanesulfonic acid soda, and 0.5 g of a 5% aqueous solution of p-octylphenoxypolyoxyethylene ether (polymerization degree: 10) were placed in a 700 mL pot mill, and 5.0 g of dye ExF-2 and 500 mL of zirconium oxide beads (diameter: 1 mm) were added to the mill. The contents were dispersed for 2 hours by using a BO-type vibration mill manufactured by Chuo Koki Co., Ltd. After the dispersing operation, the contents were taken out and were added to 8 g of a 12.5% aqueous gelatin solution. The beads were removed by filtration from the resultant material, thus obtaining a dispersion of the dye in gelatin. The average grain diameter of the finely-dispersed dye grains was 0.44 μm.

Following the same procedures as above, solid dispersions ExF-3, ExF-4 and ExF-6 were obtained. The average grain sizes of these finely-dispersed dye grains were 0.24 μm, 0.45 μm and 0.52 μm, respectively. ExF-5 was dispersed by a microprecipitation dispersion method described in Example 1 of EP 549,489A. The average grain size was found to be 0.06 μm.

The compounds used in each layer of Sample 101 are as follows.

ExC-1

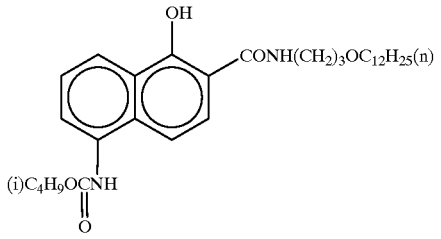

ExC-2

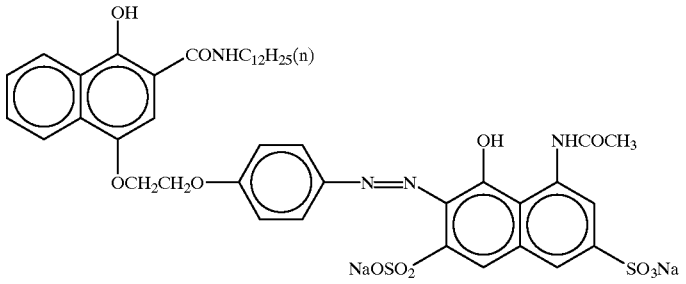

ExC-3

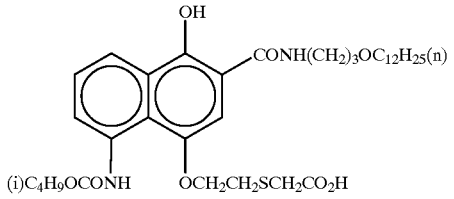

-continued
ExC-4
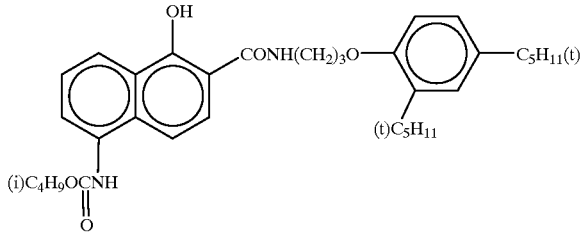
ExC-5
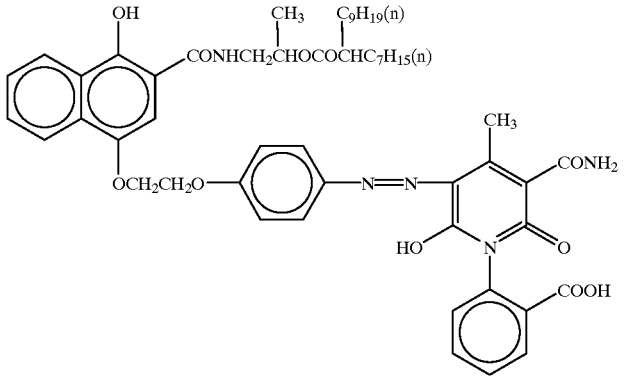
ExC-6
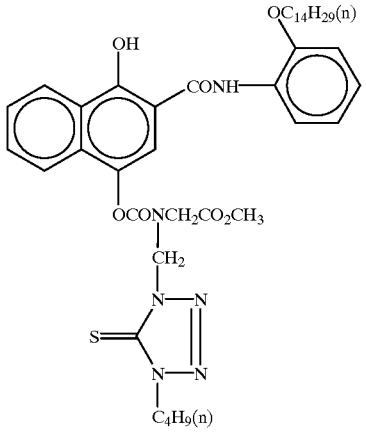
ExC-7
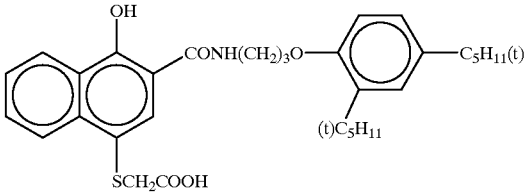

-continued
ExC-8
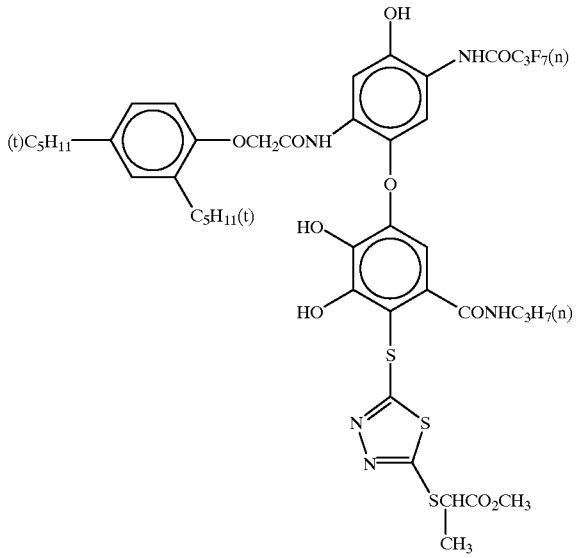
ExM-1
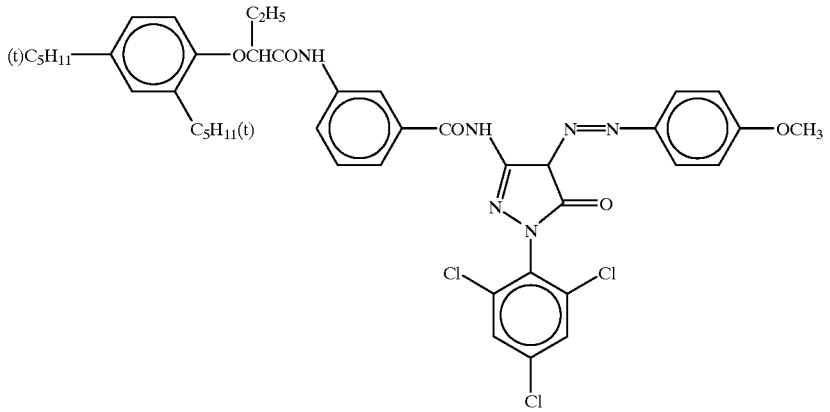
ExM-2
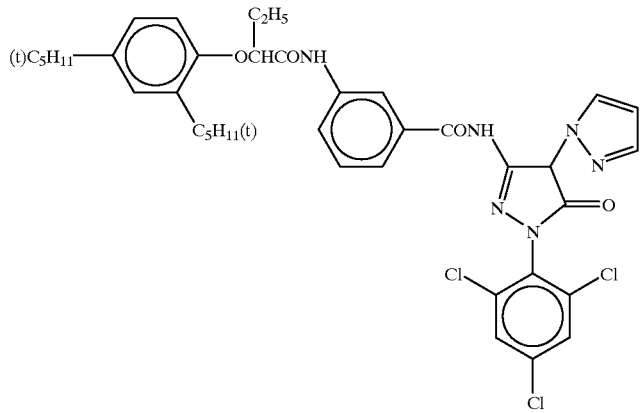

-continued
ExM-3
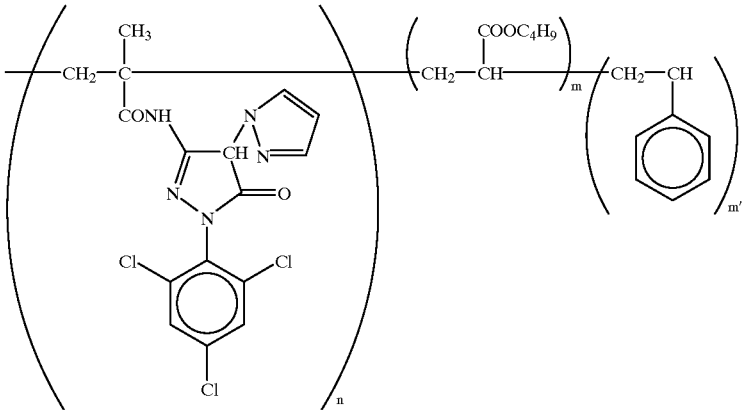
n = 50
m = 25
m′ = 25
mol. wt. About 20,000
ExM-4
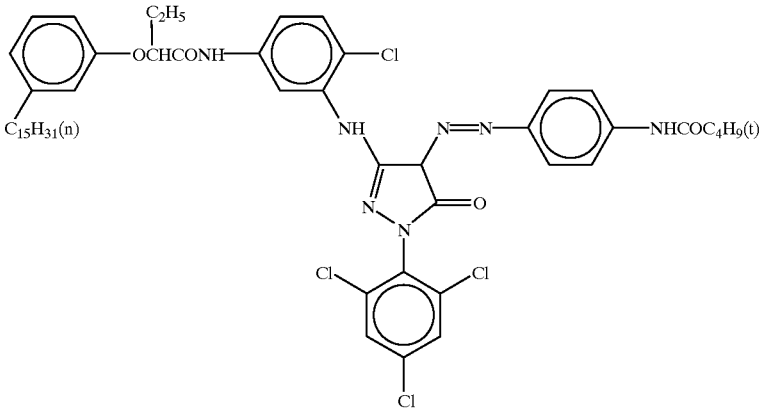
ExM-5
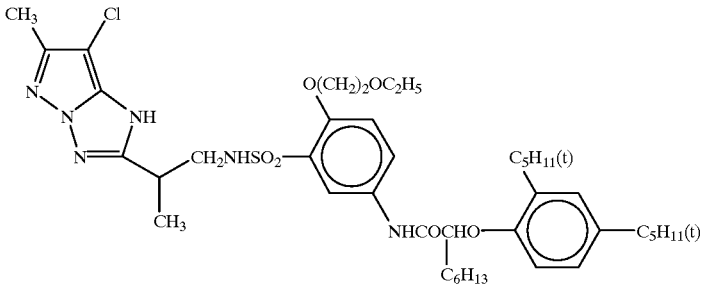
ExM-6
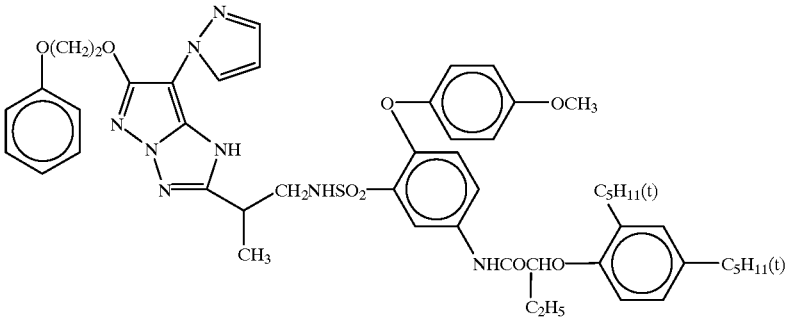

-continued
ExY-1
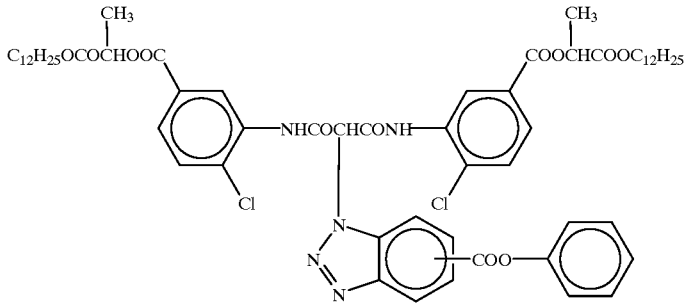
ExY-2
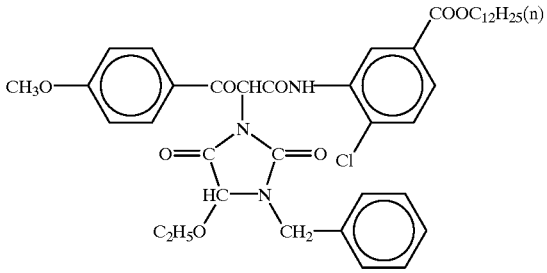
ExY-3
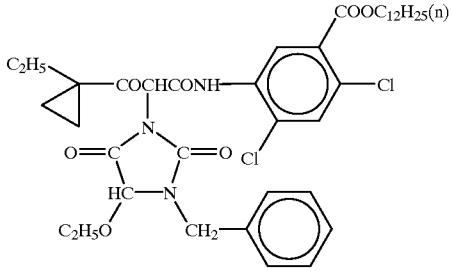
ExY-4
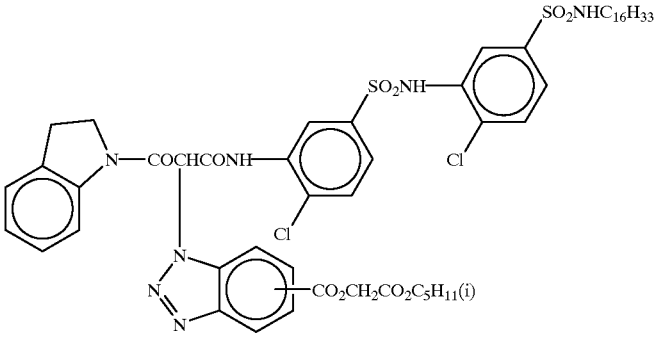
ExY-5
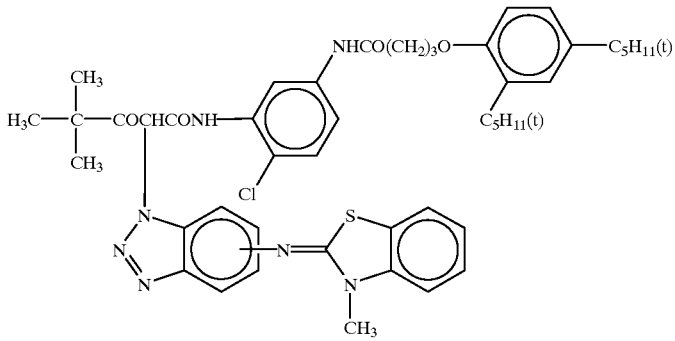

-continued
ExF-1
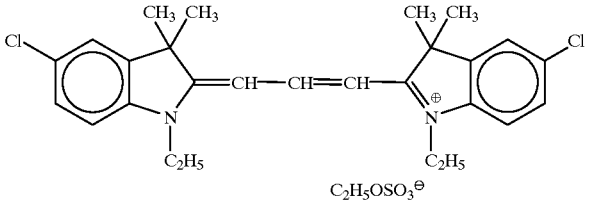
ExF-2
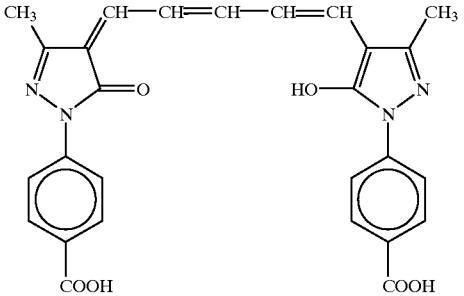
ExF-3
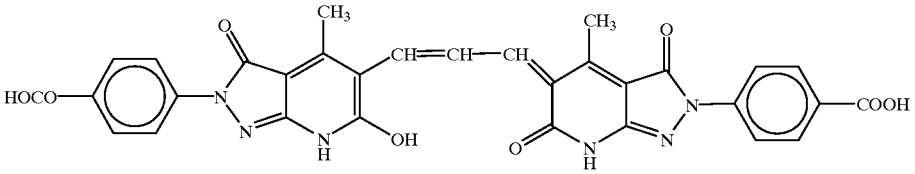
ExF-4
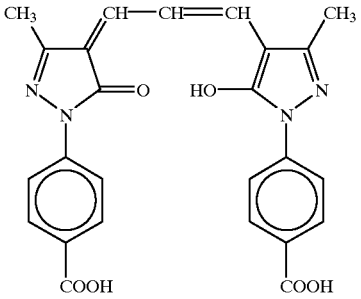
ExF-5
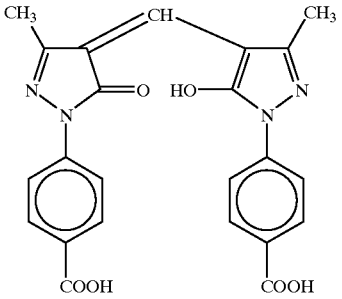
ExF-6
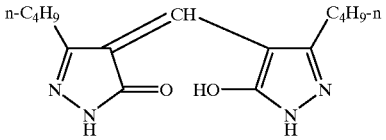

-continued
ExF-7
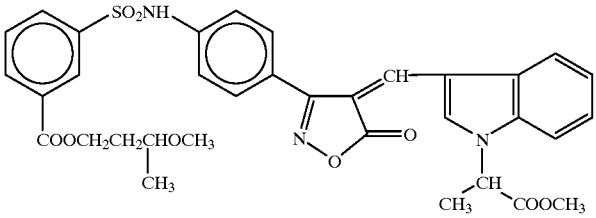
ExF-8
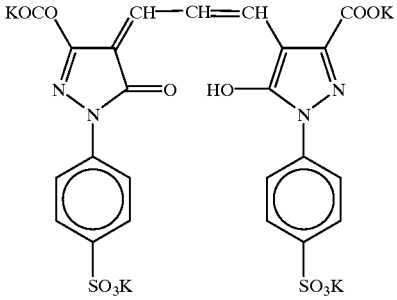
ExF-9
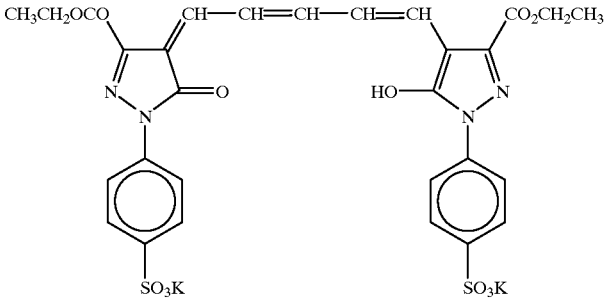
ExF-10
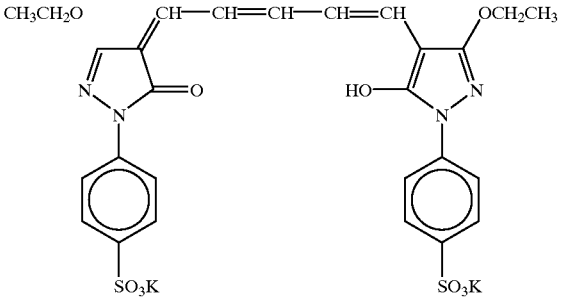
ExF-11
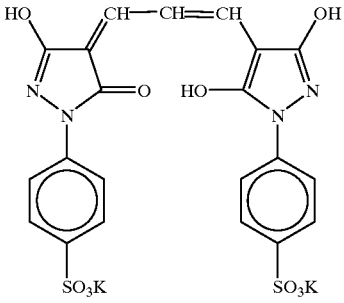

-continued
Cpd-1
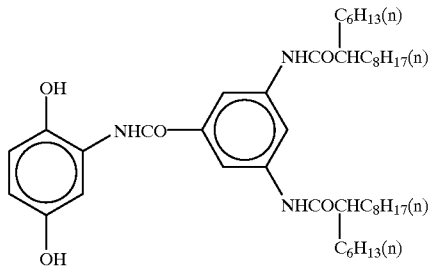
Cpd-2
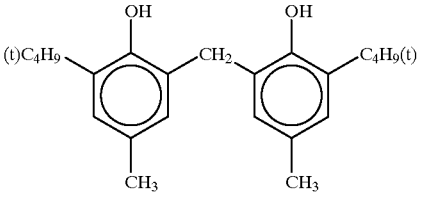
Cpd-3
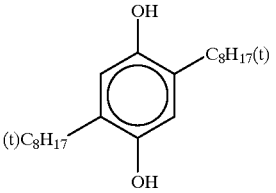
Cpd-4
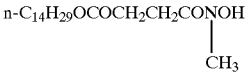
UV-1
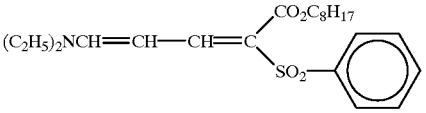
UV-2
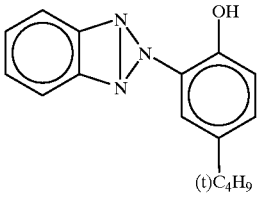
UV-3
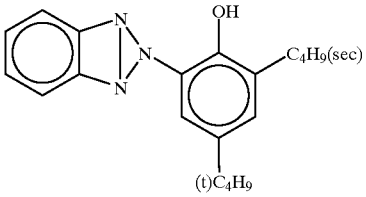
UV-4
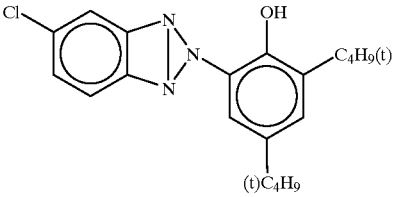

-continued
HBS-1
Tricresyl phosphate
HBS-2
Di-n-butyl phthalate
HBS-3
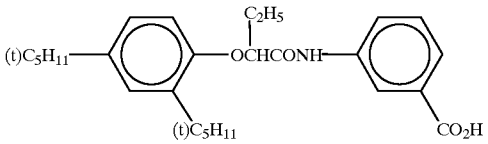
HBS-4
Tri (2-ethylhexyl) phosphate
ExS-1
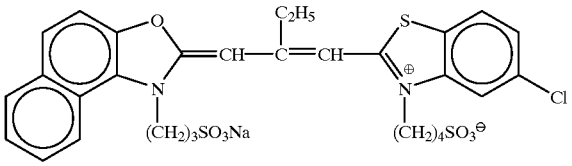
ExS-2
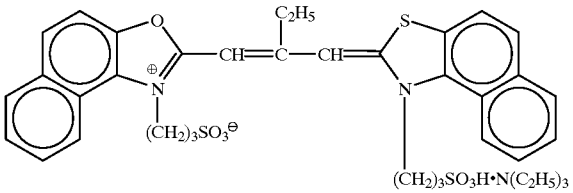
ExS-3
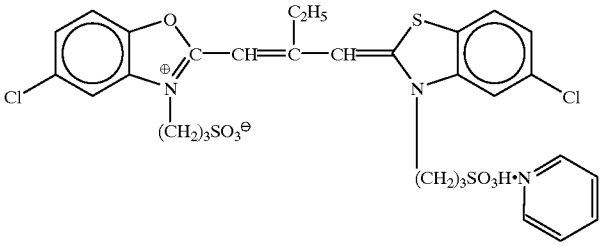
ExS-4
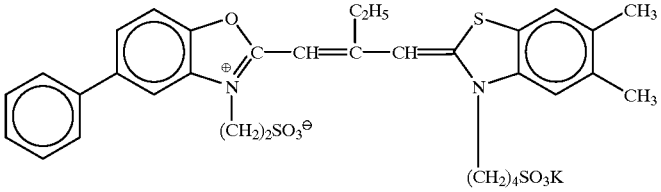
ExS-5
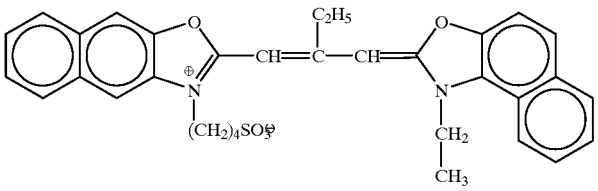
ExS-6
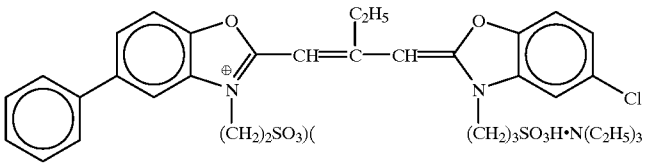

-continued
ExS-7
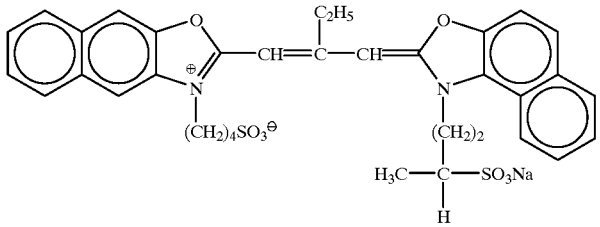
ExS-8
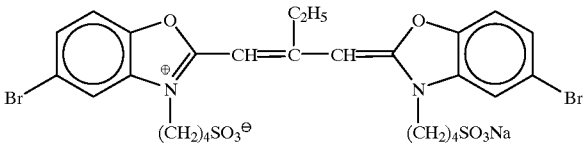
ExS-9
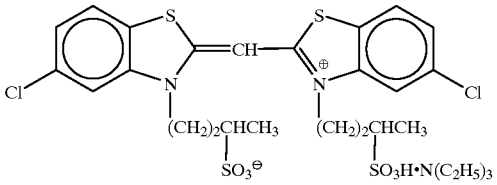
ES-1
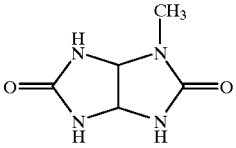
H-1
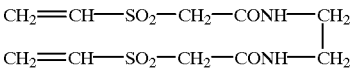
B-1
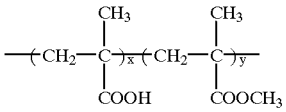
x/y = 10/90
Average Molecular Weight:
About 35,000
B-2
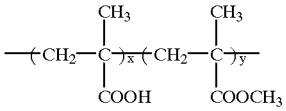
x/y = 45/55
Average Molecular Weight:
About 20,000
B-3
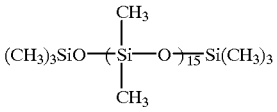
B-4
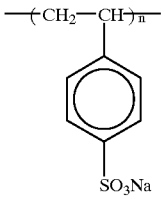
Average Molecular Weight:
About 750,000

-continued
B-5
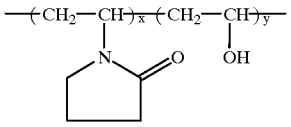
x/y = 70/30
Average Molecular Weight:
About 17,000
B-6
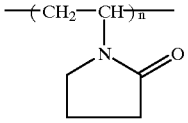
Average Molecular Weight:
About 10,000
W-1
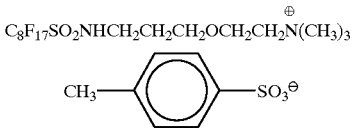
W-2
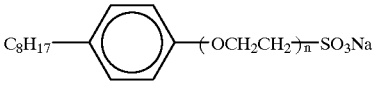
n = 2 ~ 4
W-3
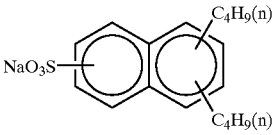
F-1
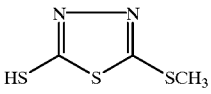
F-2
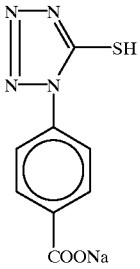
F-3
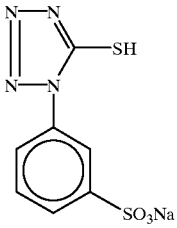
F-4
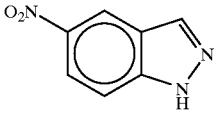

-continued
F-5
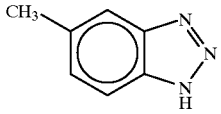
F-6
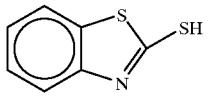
F-7
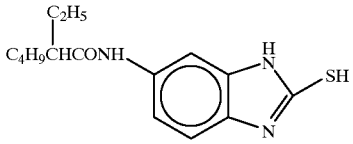
F-8
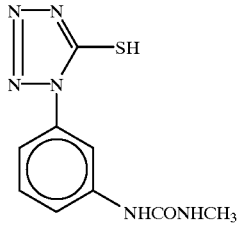
F-9
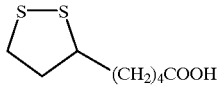
F-10
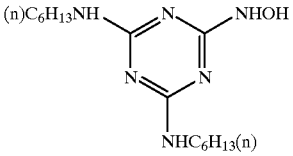
F-11
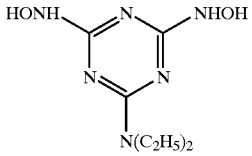
F-12
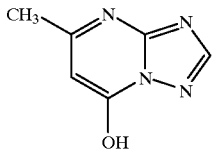
F-13
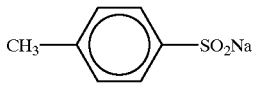
F-14
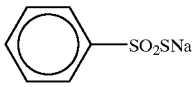

-continued

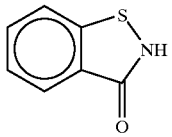

F-15

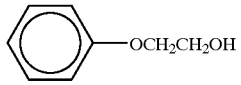

F-16

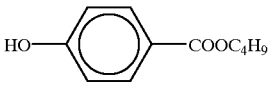

F-17

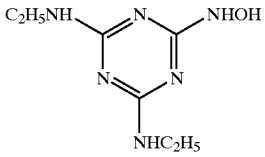

F-18

Sample 102 was prepared following the same procedures as in Sample 101 except that 1st and 3rd layers were changed as shown in Table 2 set forth below.

Sample 103 was prepared following the same procedures as in Sample 101 except that 2nd layer was formed by the following coating.

| 2nd layer (corresponding to DL) | | |
|---|---|---|
| Silver iodobromide emulsion D | silver | 0.17 g/m$^2$ |
| ExS-1 | | $1.0 \times 10^{-4}$ |
| ExS-2 | | $4.0 \times 10^{-6}$ |
| ExS-3 | | $1.4 \times 10^{-3}$ |
| Gelatin | | 0.5 |
| ExC-1 | | 0.04 |
| ExC-4 | | 0.03 |
| Cpd-2 | | 0.01 |

Samples 104 to 109 were prepared following the same procedures as in Sample 103 except that the emulsion D and the couplers, ExC-1 and ExC-4 in 2nd layer were changed as shown in the following Table 2 and the amounts of black colloidal silver in 1st and 3rd layers were changed as shown in the following Table 2.

The samples 101 to 109 made as described above were evaluated as follows:

Evaluation on Optical Information Recording (1)

Wedge exposure to light of the prepared samples with white light was made from the reverse side of the emulsion-coated side relative to the support, i.e., from the backside. No exposure to light was made from the front side of the sample. Then, developing processing was performed by the following steps.

| (Processing steps) | | |
|---|---|---|
| Step | Time | Temperature |
| Color development | 3 min 15 sec | 38° C. |
| Bleaching | 1 min 0 sec | 38° C. |
| Bleaching fixing | 3 min 15 sec | 38° C. |

-continued

| (Processing steps) | | |
|---|---|---|
| Step | Time | Temperature |
| Water washing (1) | 40 sec | 35° C. |
| Water washing (2) | 1 min 0 sec | 35° C. |
| Stabilizing | 40 sec | 38° C. |
| Drying | 1 min 15 sec | 55° C. |

The compositions of the processing solutions are shown below.

| (Color developing solution) (unit: g, except for otherwise indicated) | | |
|---|---|---|
| Diethylenetriamiriepentaacetic acid | 1.0 | |
| 1-hydroxyethylidene-1,1-diphosphonic acid | 2.0 | |
| Sodium sulfite | 4.0 | |
| Potassium carbonate | 30.0 | |
| Potassium bromide | 1.4 | |
| Potassium iodide | 1.5 | mg |
| Hydroxylamine sulfate | 2.4 | |
| 4-[N-ethyl-N-(β-hydroxyethyl)amino]-2-methylaniline sulfate | 4.5 | |
| Water to make | 1.0 | L |
| pH (adjusted by potassium hydroxide and sulfuric acid) | 10.05 | |

| (Bleaching solution) (unit: g, except for otherwise indicated) | | |
|---|---|---|
| Ferric sodium ethylenediaminetetraacetate Dihydrate | 120.0 | |
| Disodiumethylene diaminetetraacetate | 10.0 | |
| Ammonium bromide | 100.0 | |
| Ammonium nitrate | 10.0 | |
| Bleaching promoting agent $(CH_3)_2N—CH_2—CH_2—S—S—CH_2—CH_2—N(CH_3)_2.2HCl$ | 0.005 | mol |
| Ammonia water (27%) | 15.0 | mL |
| Water to make | 1.0 | L |
| pH (adjusted by ammonia water and nitric acid) | 6.3 | |

-continued

| (Bleaching fixing solution) (unit: g, except for otherwise indicated) | | |
|---|---|---|
| Ferric ammonium ethylenediaminetetraacetate Dihydrate | 50.0 | |
| Disodiumethylenediaminetetraacetate | 5.0 | |
| Sodium sulfite | 12.0 | |
| Aqueous thiosulfate ammonium solution (700 g/L) | 240.0 | mL |
| Ammonia water (27%) | 6.0 | mL |
| Water to make | 1.0 | L |
| pH (adjusted by ammonia water and acetic acid) | 7.2 | |

(Washing Water)

Tap water was supplied to a mixed-bed column filled with an H-type strongly acidic cation exchange resin (Amberlite IR-120B: available from Rohm & Haas Co.) and an OH-Type strongly basic anion exchange resin (Amberlite IR-400) to set the concentrations of calcium and magnesium to be 3 mg/L or less. Subsequently, 20 mg/L of sodium isocyanuratechlonide and 150 mg/L of sodium sulfate were added. The pH of the solution ranged from 6.5 to 7.5.

| (Stabilizer) (unit: g, except for otherwise indicated) | | |
|---|---|---|
| Sodium p-toluene sulfinate | 0.03 | |
| Polyoxyethylene p-monononylphenyl ether (average polymerization degree: 10) | 0.2 | |
| Disodiumethylene diaminetetraacetate | 0.05 | |
| 1,2,4-triazole | 1.3 | |
| 1,4-bis(1,2,4-triazol-1-ylmethyl)piperazine | 0.75 | |
| Water to make | 1.0 | L |
| pH | 8.5 | |

Each density of the samplers were measured, and an exposure amount which gives the density of minimum density part of cyan color image+0.1 was obtained. An value of logarithm of a reciprocal number of the aforementioned exposure amount was adopted as the sensitivity from the back side.

Table 3 set forth below shows relative values to the value of the sample 101.

Evaluation of Optical Information (2)

A constant exposure was given to the prepared samples from the front side so that the cyan density became 2.0 and further wedge exposure was performed from the back side and, thereafter, developing processing was performed following the above-mentioned procedures.

Each density of the samples was measured and each difference of (maximum cyan density—minimum density) was obtained.

When this value is larger, the density of optical information recording by exposure from the back side is higher.

Evaluation of Optical Recording (3)

The prepared samples were processed into 135 size, packed into a patrone, various subjects were photographed with a camera having such the function that records photographing date from the back side, which were subjected to the developing treatment following the above-mentioned processing steps and printed on color papers to evaluate visually. Evaluation criteria were as follows:

○: Date can be read in most prints.

Δ: Date can be read in only a part of prints.

X: Date can be read in little prints.

The above results are summarized in the following Table 3.

TABLE 2

| Sample No. | Coated amount of black colloidal silver in 1st layer corresponding to AH-2; in terms of silver ($g/m^2$) | Emulsion in 2nd layer corresponding to DL, and couplers added there to | Coated amount of black colloidal silver in 3rd layer corresponding to AH-1; in terms of silver ($g/m^2$) |
|---|---|---|---|
| 101 | 0.075 | gelatin alone | 0.280 |
| 102 | 0.002 | gelatin alone | 0.180 |
| 103 | 0.075 | AgBrI emulsion D<br>ExC-1 0.04 g<br>ExC-4 0.03 g | 0.280 |
| 104 | 0.075 | AgBrI emulsion C<br>ExC-1 0.04 g<br>ExC-4 0.03 g | 0.280 |
| 105 | 0 | AgBrI emulsion X<br>ExC-1 0.04 g<br>ExC-4 0.03 g | 0.355 |
| 106 | 0 | AgBrI emulsion X<br>ExC-1 0.04 g<br>ExC-4 0.03 g | 0.178 |
| 107 | 0 | AgBrI emulsion X<br>ExC-1 0.04 g<br>ExC-4 0.03 g | 0.268 |
| 108 | 0.075 | AgBrI emulsion C<br>ExC-1 0.04 g<br>ExC-3 0.05 g<br>ExC-2 0.04 g | 0.280 |
| 109 | 0.075 | AgBrI emulsion C<br>ExC-1 0.04 g<br>ExC-3 0.05 g<br>ExY-1 0.01 g | 0.280 |

TABLE 3

| Sample No. | Sensitivity obtained by exposure to light from the back side, without exposure from front side: Evaluation (1) | Density of optical information obtained by exposure to light from back side, with a certain amount of light from front side: Evaluation (2) | Visual observation of date recording: Evaluation (3) | Infrared absorbing concentration at 950 nm | Remarks |
|---|---|---|---|---|---|
| 101 | control | 0.05 | × | 2.05 | Comparison |
| 102 | +0.60 | 0.08 | Δ | 1.62 | Comparison |
| 103 | +0.80 | 0.25 | ○ | 2.12 | Invention |
| 104 | +0.60 | 0.27 | ○ | 2.12 | Invention |
| 105 | +0.48 | 0.28 | ○ | 2.10 | Invention |
| 106 | +0.48 | 0.28 | ○ | 1.65 | Invention |
| 107 | +0.48 | 0.28 | ○ | 1.88 | Invention |
| 108 | +0.64 | 0.32 | ○ | 2.12 | Invention |
| 109 | +0.55 | 0.26 | ○ | 2.12 | Invention |

As seen from Table 3, in a case where an amount of black colloidal silver to be coated is reduced to raise the sensitivity from the back side (sample 102), if exposure from the front side is not present, optical information becomes easy to be recorded.

However, if exposure from the front side is present, that effect is small.

Since there is actually a rare case where exposure from the front side is not present, it is required to manifest improved effect when exposure from the front side is present.

In this respect, the effect is recognized only in the samples 103 to 109 provided with DL.

Also, when various subjects are photographed and recording of photographing date is evaluated, the effect is recognized only in the samples 103 to 109 provided with DL.

In addition, the samples having the lower infrared concentration at 950 nm, i.e., having a small amount of coated silver (samples 106 and 107), showed sufficient optical recording but caused conveyance troubles in the automatic developing apparatus in some cases.

We claim:

1. A silver halide color photographic light-sensitive material having at least one red-sensitive silver halide emulsion layer (RL), at least one green-sensitive silver halide emulsion layer (GL) and at least one blue-sensitive silver halide emulsion layer (BL) on a support, and further having a hydrophilic colloidal layer (AH-1) containing black colloidal silver between the support and the nearest light-sensitive silver halide emulsion layer to said support among said red-sensitive silver halide emulsion layer (RL), said green-sensitive silver halide emulsion layer (GL) and said blue-sensitive silver halide emulsion layer (BL), wherein said light-sensitive material further has a light-sensitive silver halide emulsion layer (DL) between said hydrophilic colloidal layer (AH-1) and the support, wherein said silver halide emulsion layer (DL) comprises at least one light-sensitive silver halide emulsion, and optical information is recorded by an exposure to light through said support; said light-sensitive emulsion layer (DL) or its adjacent layer has a color-forming coupler, wherein an infrared absorbing concentration of the light-sensitive material at 950 nm is not less than 1.7.

2. A silver halide color photographic light-sensitive material having at least one red-sensitive silver halide emulsion layer (RL), at least one green-sensitive silver halide emulsion layer (GL) and at least one blue-sensitive silver halide emulsion layer (BL) on a support, and further having a hydrophilic colloidal layer (AH-1) containing black colloidal silver between the support and the nearest light-sensitive silver halide emulsion layer to said support among said red-sensitive silver halide emulsion layer (RL), said green-sensitive silver halide emulsion layer (GL) and said blue-sensitive silver halide emulsion layer (BL), wherein said light-sensitive material further has a light-sensitive silver halide emulsion layer (DL) between said hydrophilic colloidal layer (AH-1) and the support, wherein said silver halide emulsion layer (DL) comprises at least one light-sensitive silver halide emulsion, and optical information is recorded by an exposure to light through said support; said light-sensitive emulsion layer (DL) or its adjacent layer has a color-forming coupler, wherein the light-sensitive material further comprises a hydrophilic colloidal layer (AH-2) containing black colloidal silver between said light-sensitive emulsion layer (DL) and said support, and wherein an amount of coated black colloidal silver contained in said hydrophilic colloidal layer (AH-1) ranges from 0.01 $g/m^2$ to 1.0 $g/m^2$ in terms of silver.

3. The light-sensitive material according to claim 2, wherein at least one of said light-sensitive emulsions contained in said silver halide emulsion layer (DL) for recording optical information by an exposure through said support, is a red-sensitive silver halide emulsion.

4. The light-sensitive material according to claim 2, wherein said amount of coated black colloidal silver ranges from 0.25 to 1.0 $g/m^2$ in terms of silver.

5. The light-sensitive material according to claim 2, wherein the total amount of coated black colloidal silver contained in the hydrophilic colloidal layers (AH-1) and (AH-2) ranges from 0.01 $g/m^2$ to 1.0 $g/m^2$ in terms of silver.

6. The light-sensitive material according to claim 5, wherein said total amount of coated black colloidal silver ranges from 0.25 $g/m^2$ to 1.0 $g/m^2$ in terms of silver.

7. The light-sensitive material according to claim 1, wherein at least one of said light-sensitive emulsions contained in said silver halide emulsion layer (DL) for recording optical information by an exposure through said support, is a red-sensitive silver halide emulsion.

8. A silver halide color photographic light-sensitive material having at least one red-sensitive silver halide emulsion layer (RL), at least one green-sensitive silver halide emulsion layer (GL) and at least one blue-sensitive silver halide emulsion layer (BL) on a support, and further having a hydrophilic colloidal layer (AH-1) containing black colloidal silver between the support and the nearest light-sensitive silver halide emulsion layer to said support among said red-sensitive silver halide emulsion layer (RL), said green-sensitive silver halide emulsion layer (GL) and said blue-sensitive silver halide emulsion layer (BL), wherein said light-sensitive material further has a light-sensitive silver halide emulsion layer (DL) between said hydrophilic colloidal layer (AH-1) and the support, wherein said silver halide emulsion layer (DL) comprises at least one light-sensitive silver halide emulsion, and optical information is recorded by an exposure to light through said support; said light-sensitive emulsion layer (DL) or its adjacent layer has a color-forming coupler, wherein the light-sensitive material which comprises a hydrophilic colloidal layer (AH-2) containing black colloidal silver between said light-sensitive emulsion layer (DL) and said support.

* * * * *